US011653151B2

(12) United States Patent
Li et al.

(10) Patent No.: US 11,653,151 B2
(45) Date of Patent: May 16, 2023

(54) SPEAKER DEVICE

(71) Applicant: SHENZHEN SHOKZ CO., LTD., Guangdong (CN)

(72) Inventors: Chaowu Li, Shenzhen (CN); Yongjian Li, Shenzhen (CN); Yueqiang Wang, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 162 days.

(21) Appl. No.: 17/305,245

(22) Filed: Jul. 1, 2021

(65) Prior Publication Data

US 2021/0329360 A1 Oct. 21, 2021

Related U.S. Application Data

(63) Continuation of application No. PCT/CN2019/102402, filed on Aug. 24, 2019.

(30) Foreign Application Priority Data

Jan. 5, 2019 (CN) ..... 201910009874.6

(51) Int. Cl.
*H04R 25/00* (2006.01)
*H04R 9/06* (2006.01)
(Continued)

(52) U.S. Cl.
CPC ..... *H04R 9/06* (2013.01); *H04R 1/105* (2013.01); *H04R 1/1008* (2013.01);
(Continued)

(58) Field of Classification Search
CPC .... H04R 25/02; H04R 25/604; H04R 25/505; H04R 25/48; H04R 2225/025
See application file for complete search history.

(56) References Cited

U.S. PATENT DOCUMENTS 3,906,170 A * 9/1975 Guice ..... H04R 25/65 381/322
2016/0329041 A1 11/2016 Qi et al.
(Continued)

FOREIGN PATENT DOCUMENTS

CN 204465795 U 7/2015
CN 106604174 A 4/2017
(Continued)

OTHER PUBLICATIONS

International Search Report in PCT/CN2019/102402 dated Nov. 21, 2019, 8 pages.
(Continued)

*Primary Examiner* — Amir H Etesam
(74) *Attorney, Agent, or Firm* — Metis IP LLC

(57) ABSTRACT

The present disclosure relates to a speaker device. The speaker device may include a core housing, a circuit housing, an ear hook, and a housing sheath. The circuit housing may be configured to accommodate a control circuit or a battery. The control circuit or the battery may be configured to drive an earphone core to vibrate to generate a sound. The core housing may be configured to accommodate the earphone core. The core housing may include a housing front panel facing a human body and a housing rear panel opposite to the housing front panel. The earphone core may be configured to cause the housing front panel and the housing rear panel to vibrate. Vibration of the housing front panel may have a first phase, and vibration of the housing rear panel may have a second phase. An absolute value of a difference between the first phase and the second phase may be less than 60 degrees when a frequency of each of the vibration of the housing front panel and the vibration of the housing rear panel is within a range between 2000 Hz and 3000 Hz. The ear hook may be configured to connect the core housing and the circuit housing. The housing sheath
(Continued)

may at least partially cover the circuit housing and the ear hook. The housing sheath may be made of a waterproof material. The waterproof effect of a speaker device may be improved through sealed connections between various components of the speaker device in this the present disclosure.

20 Claims, 18 Drawing Sheets

(51) Int. Cl.
*H04R 9/02* (2006.01)
*H04R 1/10* (2006.01)

(52) U.S. Cl.
CPC ..... *H04R 1/1025* (2013.01); *H04R 1/1091* (2013.01); *H04R 9/02* (2013.01); *H04R 9/025* (2013.01); *H04R 25/65* (2013.01); *H04R 25/658* (2013.01); *H04R 2225/021* (2013.01); *H04R 2400/11* (2013.01); *H04R 2460/13* (2013.01)

(56) References Cited

U.S. PATENT DOCUMENTS

| | | | | |
|---|---|---|---|---|
| 2017/0006387 | A1* | 1/2017 | Kah, Jr. ..... | H04R 25/02 |
| 2021/0067879 | A1 | 3/2021 | Li et al. | |

FOREIGN PATENT DOCUMENTS

| | | | |
|---|---|---|---|
| CN | 107493532 | A | 12/2017 |
| CN | 109121038 | A | 1/2019 |
| WO | 2016206029 | A1 | 12/2016 |
| WO | 2017039039 | A1 | 3/2017 |

OTHER PUBLICATIONS

Written Opinion in PCT/CN2019/102402 dated Nov. 21, 2019, 10 pages.

* cited by examiner

SPEAKER DEVICE

CROSS REFERENCE TO RELATED APPLICATIONS

This application is a Continuation of International Patent Application No. PCT/CN2019/102402, filed on Aug. 24, 2019, which claims priority of Chinese Patent Application No. 201910009874.6, filed on Jan. 5, 2019, and the entire contents of each of which are incorporated herein by reference.

TECHNICAL FIELD

The present disclosure relates to a speaker device, and in particular, to a speaker device with waterproof function.

BACKGROUND

In general, people can hear sound because the air transmits vibration to the eardrum through the external ear canal, and the vibration formed by the eardrum drives the human auditory nerves, and people can perceive the vibration of the sound. At present, earphones are widely used in people's lives. For example, users can use earphones to play music, answer calls, etc. Earphones have become an important item in people's daily life. Generally, earphones in the market may not satisfy user's requirement in some scenes, such as swimming, outdoor, rainy days, etc. An earphone with waterproof function with relatively good sound quality is more popular. Therefore, it is desirable to provide a speaker device with a waterproof function.

SUMMARY

According to an aspect of the present disclosure, a speaker device is provided. The speaker device may include a core housing, a circuit housing, an ear hook, and a housing sheath. The circuit housing may be configured to accommodate a control circuit or a battery. The control circuit or the battery may be configured to drive an earphone core to vibrate to generate a sound. The core housing may be configured to accommodate the earphone core. The core housing may include a housing front panel facing a human body and a housing rear panel opposite to the housing front panel. The earphone core may be configured to cause the housing front panel and the housing rear panel to vibrate. Vibration of the housing front panel may have a first phase, and vibration of the housing rear panel may have a second phase. An absolute value of a difference between the first phase and the second phase may be less than 60 degrees when a frequency of each of the vibration of the housing front panel and the vibration of the housing rear panel is within a range between 2000 Hz and 3000 Hz. The ear hook may be configured to connect the core housing and the circuit housing. The housing sheath may at least partially cover the circuit housing and the ear hook. The housing sheath may be made of a waterproof material.

In some embodiments, the housing sheath may include a bag-like structure with an open end. The circuit housing may enter the housing sheath through the open end of the housing sheath.

In some embodiments, the open end of the housing sheath may include an annular flange that protrudes inward. The annular flange may abut against an end of the circuit housing away from the ear hook when the housing sheath covers a periphery of the circuit housing.

In some embodiments, a sealant may be applied to a joint area between the annular flange and the end of the circuit housing away from the ear hook to connect the housing sheath and the circuit housing in a sealed manner.

In some embodiments, the end of the circuit housing away from the ear hook may include a first annular table. The first annular table may be configured to connect with the annular flange in a clamping manner for positioning the housing sheath.

In some embodiments, the first annular table may include a positioning block that extends along a direction in which the circuit housing is away from the ear hook. The annular flange of the housing sheath may include a positioning groove corresponding to the positioning block. The positioning groove may be configured to accommodate at least a portion of the positioning block for positioning the housing sheath.

In some embodiments, the circuit housing may include two sub-housings connected to each other in a snap-fit connection. The housing sheath may cover a joint seam of the two sub-housings.

In some embodiments, joint surfaces of the two sub-housings abutted on each other may include stepped structures that are mutually matched.

In some embodiments, a plurality of mounting holes may be disposed on the circuit housing. A first glue tank may be recessed on an outer surface of the circuit housing. The plurality of mounting holes may be disposed in the first glue tank. The speaker device may further include a plurality of conductive pillars each of which is inserted into one mounting hole of the plurality of mounting holes. The housing sheath may include one or more exposure holes configured to expose the plurality of conductive pillars. A sealant may be applied in the first glue tank to seal the housing sheath and the circuit housing on a periphery of the plurality of mounting holes.

In some embodiments, the speaker device may include an auxiliary film. The auxiliary film may include a board. A hollow region may be disposed on the board. The board may be disposed on an inner surface of the circuit housing. The plurality of mounting holes may be disposed inside the hollow region to form a second glue tank on the periphery of the plurality of conductive pillars. A sealant may be applied in the second glue tank to seal the plurality of mounting holes and the circuit housing.

In some embodiments, the core housing may include a first socket. The ear hook may include an elastic metal wire and a first plug end. The first plug end may be disposed on an end of the elastic metal wire. The first plug end may be connected to the first socket in a plugged-in connection.

In some embodiments, a stopping block may be disposed on an inner side wall of the first socket. The first socket may include an insertion unit and two elastic hooks. At least a portion of the insertion unit may be inserted into the first socket and abutted against an outer surface of the stopping block. The two elastic hooks may be disposed on a side of the insertion unit facing an inside of the core housing. The two elastic hooks may be drawn close to each other under the action of an external force and the stopping block. After passing the stopping block, the two elastic hooks may elastically return to be clamped on the inner surface of the stopping block to form a plugged-in connection between the core housing and the first plug end.

In some embodiments, at least a portion of the insertion unit may be inserted into the first socket. The other portion of the insertion unit outside of the first socket may have a stepped structure and form a second annular table. The second annular table may be disposed apart from an outer end surface of the core housing. The ear hook may further include a protective sleeve disposed on a periphery of the elastic metal wire and the first plug end. The protective sleeve may extend to a side of the second annular table facing the outer end surface of the core housing. The protective sleeve may elastically abut against the core housing when the core housing and the first plug end are in a plugged-in connection.

In some embodiments, the protective sleeve may include an annular abutting surface and an annular convex table. The annular abutting surface may be formed on a side of the protective sleeve facing the outer end surface of the core housing. The annular convex table may be formed inside the annular abutting surface and protruding toward the annular abutting surface. The core housing may include a connecting slope configured to connect the outer end surface of the core housing and the inner side wall of the first socket. The annular abutting surface and the annular convex table may elastically abut against the outer end surface of the core housing and the connecting slope, respectively, when the first plug end is fixedly plugged in the core housing.

In some embodiments, the vibration of the housing front panel may have a first amplitude. The vibration of the housing rear panel may have a second amplitude. A ratio of the first amplitude to the second amplitude may be within a range from 0.5 to 1.5.

In some embodiments, the vibration of the housing front panel may generate a first leaked sound wave. The vibration of the housing back may generate a second leaked sound wave. The first leaked sound wave and the second leaked sound wave may overlap to reduce an amplitude of the first leaked sound wave.

In some embodiments, the housing front panel and one or more other components of the housing may be connected via at least one of an adhesive connection, a snap-fit connection, a welding connection, or a threaded connection.

In some embodiments, the at least one of the housing front panel or the housing rear panel may be made of fiber-reinforced plastic material.

In some embodiments, the vibration caused by the earphone core may generate a driving force. The housing front panel may be connected to the earphone core via a transmission connection. At least a portion of the housing front panel may be connected to or abut against the human body of a user to transmit sound. An area of the housing front panel contacted with or abutting against the human body may include a normal line, a line where the driving force locates being unparallel to the normal line.

In some embodiments, a positive direction of the line where the driving force locates may be set outwards the speaker device from the housing front panel. A positive direction of the normal line may be set outwards the speaker device. An angle formed between the line where the driving force locates along the positive direction of the line and the normal line along the positive direction of the normal line may be an acute angle.

In some embodiments, the earphone core may include a coil and a magnetic circuit system. An axis of the coil or an axis of the magnetic circuit system may be unparallel to the normal line. The axis of the coil or the axis of the magnetic circuit system may be perpendicular to a radial plane of the coil and/or a radial plane of the magnetic circuit assembly.

In some embodiments, the driving force may have a component in a first quadrant and/or a third quadrant of an XOY plane coordinate system. An origin of the XOY plane coordinate system may be located on a contact surface between the speaker device and the human body. An X-axis of the XOY plane coordinate system may be parallel to a coronal axis of the human body. A Y-axis is parallel to a sagittal axis of the human body. A positive direction of the X-axis may face outside of the human body. A positive direction of the Y-axis may face the front of the human body.

In some embodiments, the area of the housing front panel connected with or abutting against the human body may include a plane or a quasi-plane.

In some embodiments, the earphone core further may include a magnetic circuit assembly. The magnetic circuit assembly may generate a first magnetic field. The magnetic circuit assembly may include a first magnetic unit, a first magnetically conductive unit, and at least one second magnetic unit. The first magnetic unit may generate a second magnetic field. The at least one second magnetic unit may surround the first magnetic unit. A magnetic gap may be formed between the first magnetic unit and the at least one second magnetic unit. An intensity of the first magnetic field in the magnetic gap may be greater than an intensity of the second magnetic field in the magnetic gap.

In some embodiments, the speaker device may further include a second magnetically conductive unit and at least one third magnetic unit. The at least one third magnetic unit may be connected to the second magnetically conductive unit and the at least one second magnetic unit.

In some embodiments, the speaker device may further include at least one fourth magnetic element. The at least one fourth magnetic unit may be disposed below the magnetic gap and connected to the first magnetic unit and the second magnetically conductive unit.

In some embodiments, the speaker device may further include at least one fifth magnetic unit. The at least one fifth magnetic unit may be connected to an upper surface of the first magnetically conductive unit.

In some embodiments, the speaker device may further include a third magnetically conductive unit. The third magnetically conductive unit may be connected to an upper surface of the fifth magnetic unit and configured to suppress the leakage of a magnetic intensity of the first magnetic field.

In some embodiments, the first magnetically conductive unit may be connected to an upper surface of the first magnetic unit. The second magnetically conductive unit may include a bottom plate and a sidewall. The first magnetic unit may be connected to the bottom plate of the second magnetically conductive unit.

In some embodiments, the speaker device may further include at least one electrically conductive unit. The at least one conductive unit may be connected to at least one of the first magnetic unit, the first magnetically conductive unit, or the second magnetically conductive unit.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
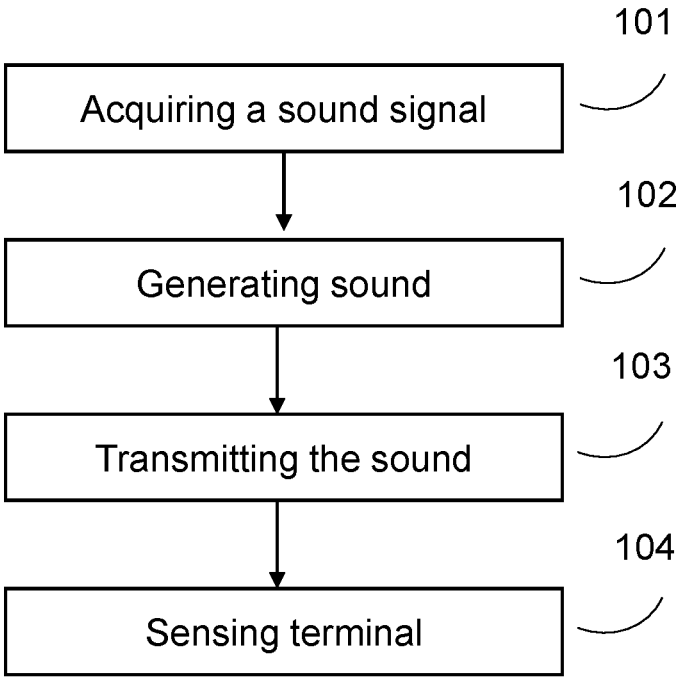
FIG. 1 is a flowchart illustrating an exemplary process for generating auditory sense through a speaker device according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those skilled in the art, without further creative efforts, may apply the present disclosure to other similar scenarios according to these drawings. It should be understood that the exemplary embodiments are provided merely for better comprehension and application of the present disclosure by those skilled in the art, and not intended to limit the scope of the present disclosure. Unless obviously obtained from the context or the context illustrates otherwise, the same numeral in the drawings refers to the same structure or operation.

As used in the disclosure and the appended claims, the singular forms "a," "an," and "the" include plural referents unless the content clearly dictates otherwise. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment." The term "another embodiment" means "at least one additional embodiment." Related definitions of other terms will be given in the description below. Hereinafter, "player," "speaker device," "loudspeaker," or "speaker" will be used in describing the sound conduction related techniques in the present disclosure. This description is only a form of speaker application. For those skilled in the art, "player," "player device," "speaker device," "speaker," or "hearing aid" can also be replaced by other similar words. In fact, the various implementations in the present disclosure may be easily applied to other non-speaker-type hearing devices. For example, for those skilled in the art, after understanding the basic principle of the speaker device, various modifications and changes to the implementation of the speaker device may be performed on the specific methods and details of the speaker device without departing from this principle. In particular, the environment sound picking and processing function may be added to the speaker device, so that the speaker device has the function of the hearing aid. For example, in the case of using a bone conduction speaker device, a sound transmitter such as a microphone may pick up an ambient sound close to the user/wearer, process the sound using a certain algorithm, and transmit the processed sound (or a generated electrical signal) to the user/wearer. That is, the bone conduction speaker device may be modified and have the function of picking up ambient sound. The ambient sound may be processed and transmitted to the user/wearer through the bone conduction speaker device, thereby implementing the function of a hearing aid. The algorithm mentioned above may include a noise cancellation algorithm, an automatic gain control algorithm, an acoustic feedback suppression algorithm, a wide dynamic range compression algorithm, an active environment recognition algorithm, an active noise reduction algorithm, a directional processing algorithm, a tinnitus processing algorithm, a multi-channel wide dynamic range compression algorithm, an active howling suppression algorithm, a volume control algorithm, or the like, or any combination thereof.

FIG. 1 is a flowchart illustrating an exemplary process for generating auditory sense through a speaker device according to some embodiments of the present disclosure. The speaker device may transfer sound to an auditory system through bone conduction or air conduction by a built-in loudspeaker, thereby generating an auditory sense. As shown in FIG. 1, the process for generating the auditory sense through the speaker device may include operations 101-104.

In 101, the speaker device may acquire or generate a signal (also referred to as a "sound signal") containing sound information. In some embodiments, the sound information refers to a video file or an audio file with a specific data format. The sound information refers to data or files that may be converted to be sound through specific approaches. In some embodiments, the signal containing the sound information may be obtained from a storage unit of a speaker device itself. In some embodiments, the signal containing the sound information may be obtained from an information generation system, a storage system, or a transmission system other than the speaker device. The signal containing the sound information may be not limited to an electrical signal, and may also include other forms of signals other than the electrical signal, such as an optical signal, a magnetic signal, and a mechanical signal, or the like. In principle, as long as the signal includes information that may be configured to generate sound by speaker device, the signal may be processed as the sound signal. In some embodiments, the sound signal may not be limited to one signal source, and it may come from a plurality of signal sources. The plurality of signal sources may be independent of or dependent on each other. In some embodiments, manners of generating or transmitting the sound signal may be wired or wireless and may be real-time or time-delayed. For example, the speaker device may receive an electrical signal containing sound information via a wired or wireless connection or may obtain data directly from a storage medium and generate a sound signal. Taking bone conduction technology as an example, components with sound collection functions may be added to a bone conduction loudspeaker. The bone conduction loudspeaker may pick up sound from ambient environment and convert mechanical vibration of the sound into an electrical signal. Further, the electrical signal may be processed through an amplifier to meet special requirements. The wired connection may be realized by using including but not limited to metal cables, optical cables, or hybrid cables of metal and optical, such as coaxial cables, communication cables, flexible cables, spiral cables, non-metal sheathed cables, metal sheathed cables, multi-core cables, twisted pair cables, ribbon cables, shielded cables, telecommunications cables, double-stranded cables, parallel twin-core wires, and twisted pairs.

The wired connection may also be realized by using other types of transmission carriers, such as transmission carriers for electrical or optical signals.

The storage device or storage unit mentioned herein may include a direct attached storage, a network attached storage, a storage area network, and other storage systems. The storage device may include but is not limited to common types of storage devices such as a solid-state storage device (a solid-state drive, a solid-state hybrid hard drive, etc.), a mechanical hard drive, a USB flash drive, a memory stick, a storage card (e.g., CF, SD, etc.), and other drives (e.g., CD, DVD, HD DVD, Blu-ray, etc.), a random access memory (RAM), a read-only memory (ROM), etc. The RAM may include but is not limited to a decimal counter, a selection tube, a delay line memory, a Williams tube, a dynamic random access memory (DRAM), a static random access memory (SRAM), a thyristor random access memory (T-RAM), a zero capacitive random access memory (Z-RAM), etc. The ROM may include but is not limited to a magnetic bubble memory, a magnetic button line memory, a thin film memory, a magnetic plating line memory, a magnetic core memory, a drum memory, an optical disk driver, a hard disk, a magnetic tape, an early non-volatile memory (NVRAM), a phase change memory, a magneto-resistive random access memory, a ferroelectric random access memory, a non-volatile SRAM, a flash memory, an electronically erasable rewritable read-only memory, an erasable programmable read-only memory, a programmable read-only memory, a shielded heap read memory, a floating connection gate random access memory, a nano random access memory, a racetrack memory, a variable resistance memory, a programmable metallization unit, etc. The storage device/storage unit mentioned above is only used for illustration purposes. The storage medium used in the storage device/unit is not limited.

In 102, the speaker device may convert the signal containing sound information into vibrations to generate a sound. The speaker device may use a specific transducer to convert the signal into mechanical vibrations accompanying with energy conversion. The conversion process may include multiple types of energy coexistence and conversion. For example, the electrical signal may be directly converted into mechanical vibrations by the transducers to generate a sound. As another example, the sound information may be included in an optical signal, which may be converted into mechanical vibrations by a specific transducer. Other types of energy that may be coexisted and converted when the transducer works may include thermal energy, magnetic field energy, or the like. In some embodiments, an energy conversion manner of the transducer may include but is not limited to, a moving coil type, an electrostatic type, a piezoelectric type, a moving iron type, a pneumatic type, an electromagnetic type, or the like. A frequency response range and sound quality of the speaker device may be affected by the energy conversion manner and a property of each physical component of the transducer. For example, in a transducer with the moving coil type, a wound cylindrical coil is connected to a vibration plate, the coil driven by a signal current drives the vibration plate to vibrate in the magnetic field, and generate a sound. Factors, such as material expansion and contraction, folds deformation, size, shape, and fixed manner of the vibration plate, the magnetic density of the permanent magnet, etc., may have a large impact on the sound quality of the speaker device.

The term "sound quality" used herein may indicate the quality of sound, which refers to an audio fidelity after post-processing, transmission, or the like. In an audio device, the sound quality may include audio intensity and magnitude, an audio frequency, an audio overtone, a harmonic component, or the like, or any combination thereof. When the sound quality is evaluated, measuring manner and the evaluation criteria for objectively evaluating the sound quality may be used, other manners that combine different elements of sound and subjective feelings for evaluating various properties of the sound quality may also be used. Thus, the sound quality may be affected during the processes of generating the sound, transmitting the sound, and receiving the sound.

In 103, the sound may be transmitted by a transmission system. In some embodiments, a transmission system refers to a substance that can deliver a vibration signal containing sound information, such as the skull, the bony labyrinth, the inner ear lymph, the spiral organ of a human or/and an animal with the auditory system. As another example, the transmission system also refers to a medium (e.g., air and liquid) that may transmit sound. To illustrate the process of transmitting sound information by the transmission system, a bone conduction loudspeaker may be taken as an example. The bone conduction loudspeaker may directly transmit sound waves (vibration signals) converted from electrical signals to an auditory center through bones. In addition, the sound waves may be transmitted to the auditory center through air conduction. More descriptions regarding the air conduction may be found elsewhere in the present disclosure.

In 104, the sound information may be transmitted to a sensing terminal. Specifically, the sound information may be transmitted to the sensing terminal through the transmission system. In a working scenario, the speaker device may pick up or generate a signal containing the sound information, convert the sound information into a sound vibration by the transducer. The speaker device may transmit the sound to the sensing terminal through the transmission system, and a user may hear the sound. Generally, a subject of the sensing terminal, the auditory system, the sensory organ, etc. described above may be a human or an animal with the auditory system. It should be noted that the following descriptions regarding the speaker device used by a human do not constitute a restriction on the use scene of the speaker device, and similar descriptions may also be applied to other animals.

The above description of the process of the speaker device is merely a specific example and should not be regarded as the only feasible implementation. Obviously, for those skilled in the art, after understanding the basic principle of the speaker device, it may be possible to make various modifications and changes in forms and details of the specific methods and operations of implementing the speaker device without departing from the principles, but these modifications and changes are still within the scope of the present disclosure.

The speaker device described according to some embodiments of the present disclosure may include, but not be limited to, an earphone, an MP3 player, a hearing aid, or other devices with speaker function. In the following specific embodiments of the present disclosure, an MP3 player is taken as an example to describe the speaker device in detail.

Figure 2:
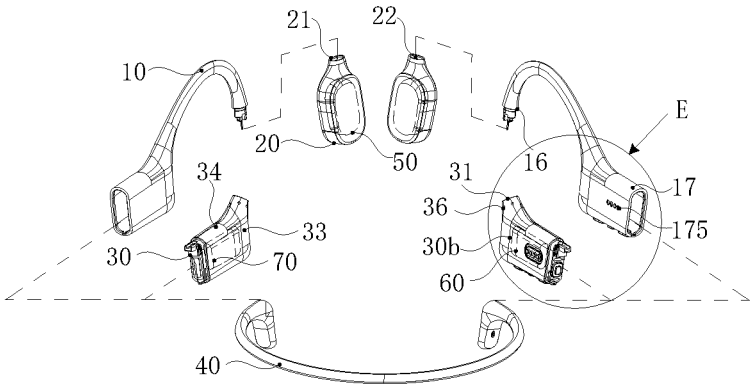
FIG. 2 is a schematic diagram illustrating an exploded structure of an exemplary MP3 player according to some embodiments of the present disclosure.

FIG. 2 is a schematic diagram illustrating an exploded structure of an exemplary MP3 player according to some embodiments of the present disclosure.

As shown in FIG. 2, in some embodiments, an MP3 player may include an ear hook 10, a core housing 20, a circuit housing 30, a rear hook 40, an earphone core 50, a control circuit 60, and a battery 70. The core housing 20 and the circuit housing 30 may be disposed at two ends of the ear hook 10 respectively, and the rear hook 40 may be further disposed at an end of the circuit housing 30 away from the ear hook 10. The number of the core housings 20 is two, which are configured to accommodate two earphone cores 50 respectively. The number of the circuit housings 30 is also two, which are configured to accommodate the control circuit 60 and the battery 70 respectively. The two ends of the rear hook 40 are connected to the corresponding circuit housings 30 respectively.

Figure 3:
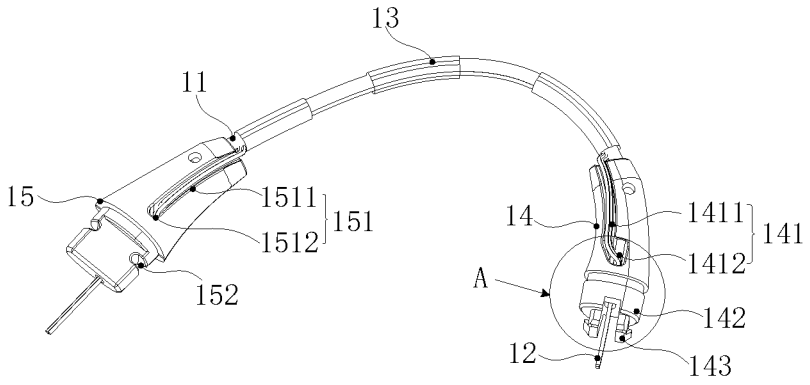
FIG. 3 is a schematic diagram illustrating a part of a structure of an ear hook of an MP3 player according to some embodiments of the present disclosure.
Figure 4:
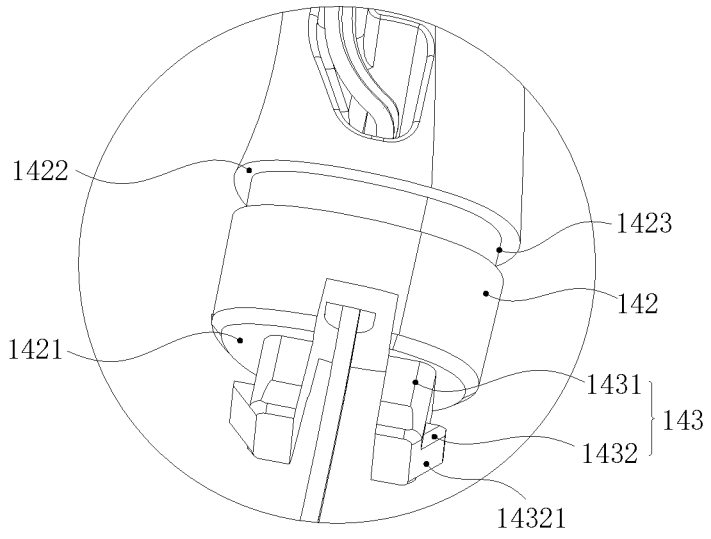
FIG. 4 is a schematic diagram illustrating a partial enlarged view of part A in FIG. 3.

FIG. 3 is a schematic diagram illustrating a part of a structure of an ear hook of an MP3 player according to some embodiments of the present disclosure. FIG. 4 is a partial sectional view of an MP3 player according to some embodiments of the present disclosure.

Referring to FIGS. 2-4, in some embodiments, the ear hook 10 may include an elastic metal wire 11, a wire 12, a fixing sleeve 13, a first plug end 14, and a second plug end 15. The first plug end 14 and the second plug end 15 may be disposed at two ends of the elastic metal wire 11, respectively. In some embodiments, the ear hook 10 may further include a protective sleeve 16 and a housing sheath 17 integrally formed with the protective sleeve 16.

In some embodiments, the protective sleeve 16 may be injection molded around the periphery of the elastic metal wire 11, the wire 12, the fixing sleeve 13, the first plug end 14, and the second plug end 15. Thus, the protective sleeve 16 may be fixedly connected with the elastic metal wire 11, the wire 12, the fixing sleeve 13, the first plug end 14, and the second plug end 15, respectively. There is no need to form the protective sleeve 16 separately by injection molding and further wrap protective sleeve 16 around the periphery of the elastic metal wire 11, the first plug end 14, and the second plug end 15, thereby simplifying the manufacturing and assembly processes and improving the reliability and stability of the fixation of the protective sleeve 16.

In some embodiments, a first wiring channel 141 and a second wiring channel 151 may be disposed on the first plug end 14 and the second plug end 15, respectively. The first wiring channel 141 may include a first wiring groove 1411 and a first wiring hole 1412 connecting with the first wiring groove 1411. The wire 12 at the first plug end 14 may extend along the first wiring groove 1411 and the first wiring hole 1412 and be exposed on the outer end surface of the first plug end 14 to further connect with other structures. Accordingly, the second wiring channel 151 may include a second wiring groove 1511 and a second wiring hole 1512 connecting with the second wiring groove 1511. The wire 12 at the second plug end 15 may extend along the second wiring groove 1511 and the second wiring hole 1512 and be exposed on the outer end surface of the second plug end 15 to further connect to other structures. An end of the wire 12 of the ear hook 10 disposed outside the core housing 20 may pass through the second wiring channel 151 to connect the circuits outside the core housing 20, such as the control circuit 60, the battery 70, etc., included in the circuit housing 30. Another end of the wire 12 may be exposed to the outer end surface of the first plug end 14 along the first wiring channel 141, and further enter the core housing 20 through a first socket 22 along with an insertion unit 142.

Referring to FIG. 2, in some embodiments, when the protective sleeve 16 is formed, a housing sheath 17 disposed on the side close to the second plug end 15 may be integrally formed with the protective sleeve 16. The housing sheath 17 may be integrally formed with the protective sleeve 16 to form a whole structure. The circuit housing 30 may be connected to one end of the ear hook 10 by being fixedly connected to the second plug end 15. The housing sheath 17 may be molded on the ear hook 10. The housing sheath 17 may be further wrapped around the periphery of the circuit housing 30 in a sleeved manner. The protective sleeve 16 and the housing sheath 17 may include soft material with certain elasticity, such as silica gel, rubber, or the like, or any combination thereof.

In some embodiments, the core housing 20 may be used to accommodate the earphone core 50 and may be plugged and fixed with the first plug end 14. The count (or the number) of the earphone cores 50 and the core housings 20 may be two, which may correspond to the left ear and the right ear of the user, respectively. For example, during an operation, the core housing 20 may be attached to a vicinity of the left ear and the right ear of the user, respectively.

Referring to FIG. 2 and FIG. 3, in some embodiments, the core housing 20 and the first plug end 14 may be connected in a plug-in manner, a clamping manner, etc., so as to fix the core housing 20 and the ear hook 10 together. That is, in the present embodiment, the ear hook 10 and the core housing 20 may be formed separately, and the ear hook 10 and the core housing 20 may be assembled instead that the ear hook 10 and the core housing 20 may be formed together integrally. In this way, the ear hook 10 and the core housing 20 may be molded separately with corresponding molds instead of using a relatively large mold to integrally form the two, which may reduce the sizes of the molds and the difficulty of the manufacture of the molds and the molding process. In addition, since the ear hook 10 and the core housing 20 are processed using different molds, when the shape or structure of the ear hook 10 or the core housing 20 needs to be adjusted in the manufacturing process, it is sufficient to adjust the mold corresponding to the structure instead of adjusting the mold of another one, thereby reducing the production cost. In some embodiments, the ear hook 10 and the core housing 20 may be integrally formed according to different needs.

Figure 5:
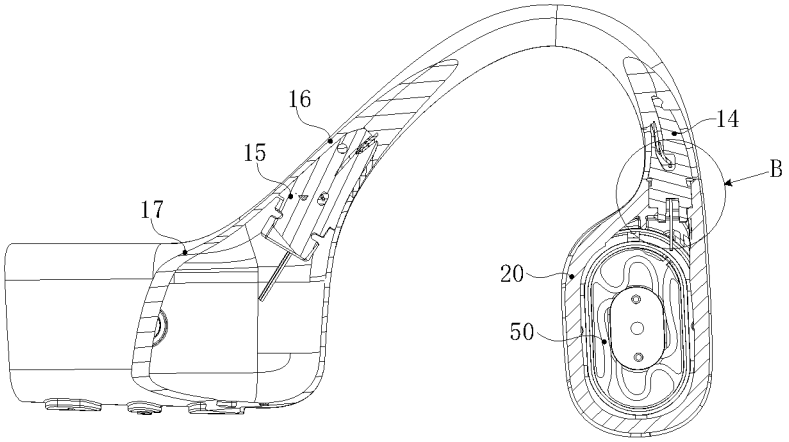
FIG. 5 is a schematic diagram illustrating a partial sectional view of an MP3 player according to some embodiments of the present disclosure.
Figure 6:
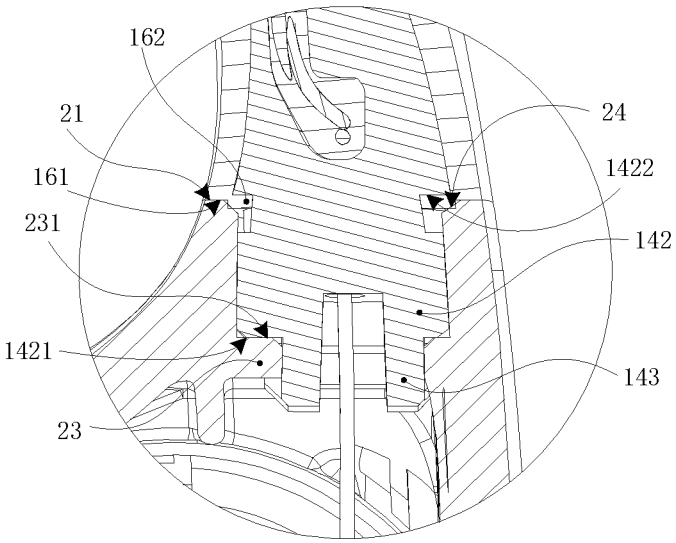
FIG. 6 is a schematic diagram illustrating a partial enlarged view of part B in FIG. 5.

FIG. 5 is a schematic diagram illustrating a partial sectional view of an MP3 player according to some embodiments of the present disclosure. FIG. 6 is a schematic diagram illustrating a partial enlarged view of part B in FIG. 5. Referring to FIG. 2, FIG. 5, and FIG. 6, in some embodiments, the core housing 20 may include a first socket 22 communicating with an outer end surface 21 of the core housing 20, and a stopping block 23 may be disposed on an inner side wall of the first socket 22. The outer end surface 21 of the core housing 20 refers to an end surface of the core housing 20 facing the ear hook 10. The first socket 22 may be configured to provide an accommodating space for the first plug end 14 of the ear hook 10, which may be inserted into the core housing 20, so as to realize the fixed plug-in connection between the first plug end 14 and the core housing 20. The stopping block 23 may be formed by the inner side wall of the first socket 22 protruding in a direction perpendicular to the inner side wall. In some embodiments, the stopping block 23 may include a plurality of block-shaped protrusions disposed at intervals. Alternatively, the stopping block 23 may be an annular protrusion extending along the inner side wall of the first socket 22, which is not limited herein.

Referring to FIG. 3 and FIG. 6, in some embodiments, the first socket 22 may include an insertion unit 142 and two elastic hooks 143. Specifically, the insertion unit 142 may be at least partially inserted into the first socket 22 and abut against an outer surface 231 of a stopping block 23. A shape of the outer side wall of the insertion unit 142 may match that of the inner side wall of the first socket 22, so that the outer side wall of the insertion unit 142 may abut against the inner side wall of the first socket 22 when the insertion unit 142 is at least partially inserted into the first socket 22. Specifically, the outer surface 231 of the stopping block 23 refers to a side of the stopping block 23 facing the ear hook 10. The insertion unit 142 may include an end surface 1421 facing the core housing 20. The end surface 1421 may match the outer surface 231 of the stopping block 23, so that the end surface 1421 of the insertion unit 142 may abut against the outer surface 231 of the stopping block 23 when the insertion unit 142 is at least partially inserted into the first socket 22.

Referring to FIG. 2 and FIG. 4, in some embodiments, the two elastic hooks 143 may be disposed on a side of the insertion unit facing an inside of the core housing. For example, the two elastic hooks 143 may be disposed side by side and spaced apart symmetrically on the side of the insertion unit 142 facing an inside of the core housing 20 along the direction of insertion. Each elastic hook 143 may include a beam portion 1431 and a hook portion 1432. The beam portion 1431 may be connected to a side of the insertion unit 142 facing the core housing 20. The hook portion 1432 may be disposed on the beam portion 1431 away from the insertion unit 142 and extend perpendicular to the inserted direction. Further, each hook portion 1432 may include a side parallel to the inserted direction and a transitional slope 14321 away from the end surface 1421 of the insertion unit 142.

Referring to FIG. 2, FIG. 3, FIG. 4, and FIG. 6, during the assembly of the ear hook 10 and the core housing 20, the first plug end 14 may gradually enter the core housing 20 from the first socket 22. That is, the first plug end 14 may be connected to the first socket 22 in a plug-in connection. When the first plug end 14 reaches a position of the stopping block 23, the two elastic hooks 143 may be blocked by the stopping block 23. The two elastic hooks 143 may be drawn close to each other under the action of an external force and the stopping block 23. After passing the stopping block 23, the two elastic hooks 143 may elastically return to be clamped on the inner surface of the stopping block 23 to form a plugged-in connection between the core housing 20 and the first plug end 14. Specifically, under the action of an external force, the stopping block 23 may gradually squeeze the transition slope 14321 of the hook portion 1432 to make the two elastic hooks 143 elastically deform and get close to each other. When the transition slope 14321 passes through the stopping block 23 and reaches the side of the stopping block 23 close to the inside of the core housing 20, the elastic hook 143 may elastically recover without blocking of the stopping block 23, and the elastic hook 143 may be clamped on an inner side of the stopping block 23 facing the core housing 20. The stopping block 23 may be clamped between the insertion unit 142 and the hook portion 1432 of the first plug end 14, thereby realizing the fixed plug-in connection of the core housing 20 and the first plug end 14.

In some embodiments, after the core housing 20 and the first plug end 14 are plugged and fixed, at least a portion of the insertion unit 142 may be inserted into the first socket 22. The other portion (i.e., the exposed portion) of the insertion unit 142 outside of the first socket may have a stepped structure, so as to form an annular table 1422 disposed apart from the outer end surface 21 of the core housing 20. It should be noted herein that the exposed portion of the insertion unit 142 refers to the portion of the insertion unit 142 exposed to the core housing 20. The exposed portion of the insertion unit 142 refers to the portion exposed to the core housing 20 and close to the outer end surface of the core housing 20.

In some embodiments, an annular table 1422 (also referred to as a second annular table) may be disposed opposite to the outer end surface 21 of the core housing 20. A space between the annular table 1422 and the outer end surface 21 refers to a space along the direction of insertion and a space perpendicular to the direction of insertion. In some embodiments, the protective sleeve 16 may extend to the side of the annular table 1422 facing the outer end surface 21 of the core housing 20. When the first socket 22 and the first plug end 14 of the core housing 20 are in a plugged-in connection, the protective sleeve 16 may be at least partially filled in the space between the annular table 1422 and the outer end surface 21 of the core housing 20, and elastically abut against the core housing 20. Thus, it is difficult for external liquid to enter the inside of the core housing 20 from a junction between the first plug end 14 and the core housing 20, thereby realizing the sealing between the first plug end 14 and the first socket 22, protecting the earphone core 50, etc. inside the core housing 20, and improving the waterproof effect of the MP3 player.

Figure 7:
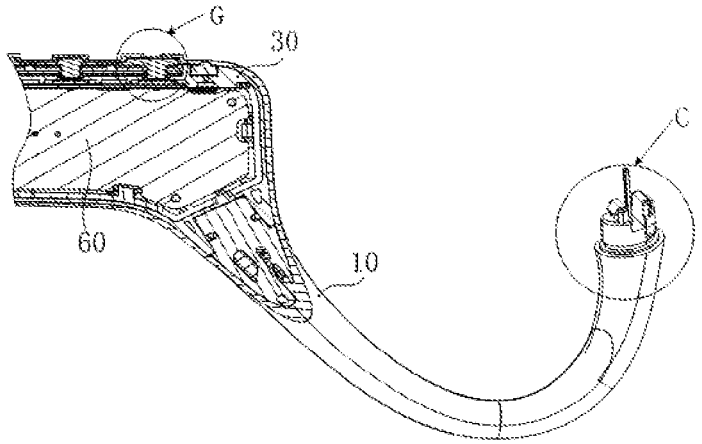
FIG. 7 is a schematic diagram illustrating a cross-sectional view of a partial structure of an MP3 player according to some embodiments of the present disclosure.
Figure 8:
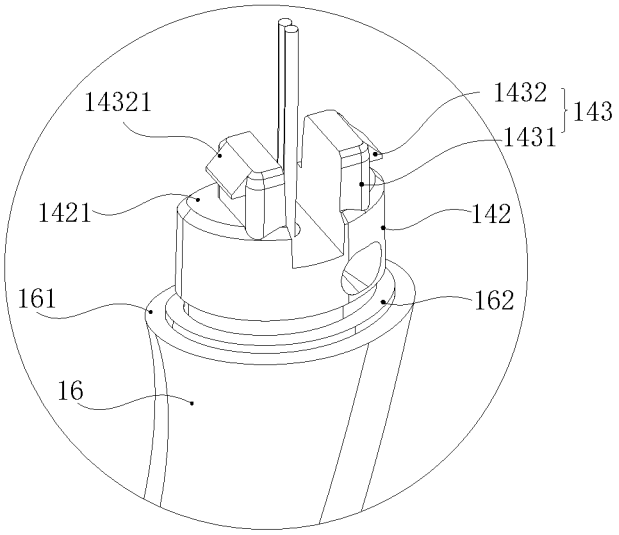
FIG. 8 is a schematic diagram illustrating a partial enlarged view of part C in FIG. 7.

FIG. 7 is a schematic diagram illustrating a cross-sectional view of a partial structure of an MP3 player according to some embodiments of the present disclosure. FIG. 8 is a schematic diagram illustrating a partial enlarged view of part C in FIG. 7. Referring to FIG. 2, FIG. 7, and FIG. 8, in some embodiments, the protective sleeve 16 may include an annular abutting surface 161 on the outer end surface 21 of the annular table 1422 facing the outer end surface of the core housing 20. The annular abutting surface 161 may be the end surface of the protective sleeve 16 facing the core housing 20.

In some embodiments, the protective sleeve 16 may further include an annular convex table 162 locating inside the annular abutting surface 161 and protruding from the annular abutting surface 161. Specifically, the annular convex table 162 may be formed inside of the annular abutting surface 161 facing the first plug end 14, and may protrude toward the core housing 20 toward the annular abutting surface 161. Further, the annular convex table 162 may be directly formed on the periphery of the annular table 1422 and cover the annular table 1422.

Referring to FIG. 2, FIG. 6, and FIG. 8, in some embodiments, the core housing 20 may include a connecting slope 24 configured to connect the outer end surface 21 of the core housing 20 and the inner side wall of the first socket 22. The connecting slope 24 may be a transitional surface between the outer end surface 21 of the core housing 20 and the inner side wall of the first socket 22. The connecting slope 24 may not be on a same plane as the outer end surface 21 of the core housing 20 and the inner side wall of the first socket 22. The connecting slope 24 may be a flat surface, a curved surface, or other shapes according to actual requirements, which is not limited herein.

In some embodiments, when the first plug end 14 is fixedly plugged in the core housing 20, the annular abutting surface 161 and the annular convex table 162 may elastically abut against the outer end surface of the core housing 20 and the connecting slope 24, respectively. It should be noted that since the outer end surface 21 of the core housing 20 and the connecting slope 24 are not on the same plane, the elastic abutment between the protective sleeve 16 and the core housing 20 may be not on the same plane. Thus, it is difficult for external liquid to enter the core housing 20 from the junction of the protective sleeve 16 and the core housing 20, and further enter the earphone core 50 thereby improving the waterproof effect of the MP3 player, protecting the inner structure of the MP3 player, and extending the service life of the MP3 player.

Referring to FIG. 2, FIG. 4, and FIG. 6, in some embodiments, the insertion unit 142 may include an annular groove 1423 on the side of the annular table 1422 facing the outer end surface 21 of the core housing 2, and the annular groove 1423 may be adjacent to the annular table 1422. The annular convex table 162 may be formed in the annular groove 1423. In this embodiment, the annular groove 1423 may form a side of the annular table 1422 facing the core housing 20. In an application scenario, the annular table 1422 may be a side wall surface of the annular groove 1423 facing the core housing 20. In such cases, the annular convex table 162 may be formed in the annular groove 1423 along the side wall surface.

Figure 9A:
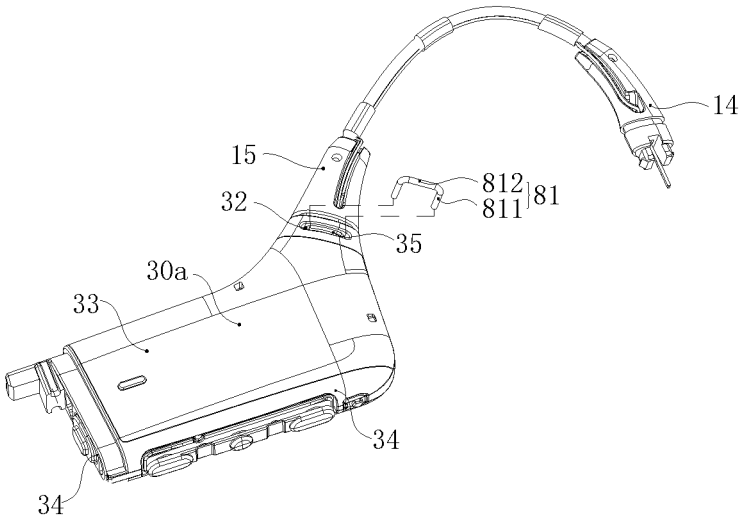
FIG. 9A is a schematic diagram illustrating an exploded view of partial structures of an exemplary circuit housing and an exemplary ear hook of an MP3 player according to some embodiments of the present disclosure.
Figure 9B:
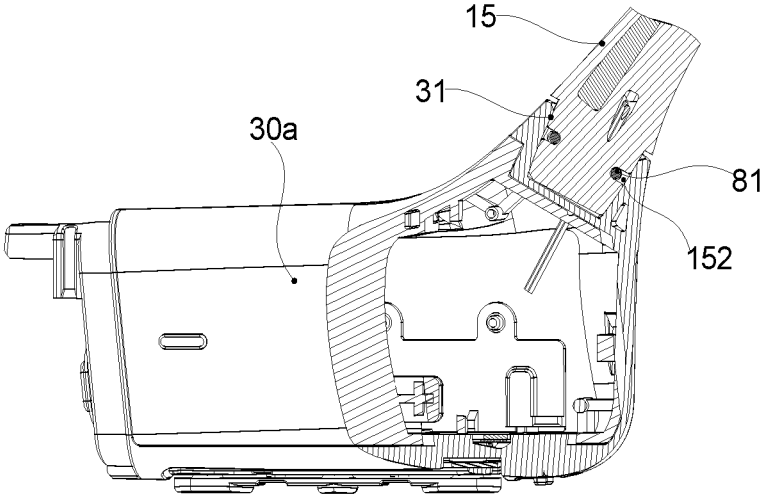
FIG. 9B is a schematic diagram illustrating a cross-sectional view of a partial structure according to some embodiments of the present disclosure.

FIG. 9A is a schematic diagram illustrating an exploded view of partial structures of an exemplary circuit housing and an exemplary ear hook of an MP3 player according to some embodiments of the present disclosure. FIG. 9B is a schematic diagram illustrating a cross-sectional view of a partial structure according to some embodiments of the present disclosure.

Referring to FIG. 2, FIG. 3, FIG. 9A, and FIG. 9B, in some embodiments, the circuit housing 30 and the second plug end 15 may be in a plugged-in connection, and the circuit housing 30 may be fixed on an end of the ear hook 10 away from the core housing 20. When worn by the user, the circuit housing 30 including the battery 70 and the circuit housing 30 including the control circuit 60 may correspond to the left and right ears of the user, respectively. A connection manner between the circuit housing 30 and the corresponding second plug end 15 and that between the control circuit 60 and the corresponding second plug end 15 may be different. In some embodiments, the circuit housing 30 may be connected to the second plug end 15 in a plug-in manner, a snapping-fit manner, or the like, or any combination thereof. In this case, the ear hook 10 and the circuit housing 30 may be formed separately, and assembled together, instead of integrally forming the ear hook 10 and the circuit housing 30. In this case, the ear hook 10 and the circuit housing 30 may be molded separately with corresponding molds instead of using a relatively large mold to integrally form the ear hook 10 and the circuit housing 30, which may reduce the sizes of the molds, the difficulty of the manufacture of the molds, and the molding process. In addition, since the ear hook 10 and the circuit housing 30 are processed using different molds, when the shape or structure of the ear hook 10 or the circuit housing 30 needs to be adjusted in the manufacturing process, the mold corresponding to the structure may be adjusted instead of adjusting the mold of another one thereby reducing the production cost.

In some embodiments, the circuit housing 30 may include a second socket 31. A shape of an inner surface of the second socket 31 may match that of at least part of the outer end surface of the second plug end 15, and the second plug end 15 may be at least partially inserted into the second socket 31. In some embodiments, two slots 152 may be disposed on each of opposite sides of the second plug end 15, and the two slots 152 may be disposed perpendicular to the inserted direction of the second plug end 15 with respect to the second socket 31, respectively. Specifically, the two slots 152 may be symmetric and spaced apart on opposite sides of the second plug end 15, and may be connected to the sidewall of the second plug end 15 in the vertical direction of the inserted direction of the second plug end 15.

The circuit housing 30 may be flat. For example, a shape of a cross-section of the circuit housing 30 at the second socket 31 may be elliptical or other shapes that may be flattened. In this embodiment, the two opposite side walls of the circuit housing 30 with a relatively large area may be main side walls 33, and two opposite side walls with a relatively small area connecting the two main side walls 33 may be auxiliary side walls 34. In the present embodiment, the first side wall 30*a* of the circuit housing 30 may include one of the main side walls 33 of the circuit housing 30 or the auxiliary side wall 34 of the circuit housing 30, which may be set according to actual requirements. In some embodiments, the cross-section of the circuit housing 30 may have a circular shape, which may be set according to actual needs.

In some embodiments, the MP3 player may include a fixing member 81. The fixing member 81 may include two parallel pins 811 and a connecting portion 812 configured to connect the pins 811. Specifically, the connecting portion 812 may be vertically connected to ends of the two pins 811 at the same side, thereby forming the U-shaped fixing member 81. In some embodiments, the first side wall 30*a* of the circuit housing 30 may disposed with two through holes 32 corresponding to the positions of the two slots 152, and the two through holes 32 may penetrate the first side wall 30*a*. Ends of the two pins 811 away from the connecting portion 812 may be inserted into the slot 152 from the outside of the circuit housing 30 through the through hole 32, and the connecting portion 812 may be blocked from the outside of the circuit housing 30, thereby plugging and fixing the circuit housing 30 and the second plug end 15.

In some embodiments, the first side wall 30*a* of the circuit housing 30 may further include a strip groove 35 configured to connect the two through holes 32. When the fixing member 81 is used for plugging and fixing the circuit housing 30 and the second plug end 15, a portion of or the entire connecting portion 812 may further be sunk in the strip groove 35. In such cases, the MP3 player may have a relatively uniform structure, and a groove corresponding to the connecting portion 812 may not be disposed on a housing sheath 17 sleeved on the periphery of the circuit casing 30, thereby simplifying the mold of the housing sheath 17. On the other hand, the space occupied by the MP3 player as a whole may be reduced to a certain extent.

In some embodiments, after a portion of or the entire connecting portion 812 is sunk in the strip groove 35, a sealant may be applied in the strip groove 35. In such cases, the fixing member 81 may be fixed on the circuit housing 30, thereby improving the stability of the connection between the second plug end 15 and the second socket 31. On the other hand, after the connecting portion 812 is sunk in the strip groove 35, the strip groove 35 may be filled with the sealant, and a surface of the strip groove 35 may be consistent with the first side wall 30*a* of the circuit housing 30, thereby improving the smooth and consistence of the strip groove 35 and surrounding structures.

Referring to FIG. 2, FIG. 3, FIG. 9A, and FIG. 9B, in some embodiments, the second side wall 30*b* of the circuit housing 30 opposite to the first side wall 30*a* of the circuit housing 30 may include through hole(s) 36 opposite to the through hole(s) 32, and the pin 811 may pass through the slot 152 and insert into the through hole(s) 36. Specifically, the first side wall 30*a* of the circuit housing 30 and the second side wall 30*b* of the circuit housing 30 may be the main side walls 33 or the auxiliary side walls 34 of the circuit housing 30. In the present embodiment, the first side wall 30*a* and the second side wall 30*b* of the circuit housing 30 may be two opposite main side walls 33 of the circuit housing 30. Two through holes 32 and two through holes 36 may be disposed on the side wall of the circuit housing 30 with a relatively larger area, respectively. A relatively large interval may be disposed between two pins 811 of the fixing member 81 to improve the span of the fixing member 81 and improve the stability of the connection between the second plug end 15 and the second socket 31.

In the present embodiment, the pin 811 may be inserted into the slot 152 through the through hole 32, and further inserted into the through hole 36 through the slot 152. That is, the pin 811 may penetrate and connect two opposite main side walls 33 of the circuit housing 30 and the second plug end 15, thereby improving the plugging stability between the second plug end 15 and the circuit housing 30.

Further, as described in the foregoing embodiments, when the protective sleeve 16 is formed, the protective sleeve 16 may be integrally formed with a housing sheath 17 disposed close to the second plug end 15. The housing sheath 17 and the circuit housing 30 may be formed separately, and the shape of the inner side wall of the housing sheath 17 may match the outer side wall of the circuit housing 30. After the housing sheath 17 and the circuit housing 30 are separately formed, the housing sheath 17 may wrap around the periphery of the circuit housing 30 in a sleeved manner. It should be noted that the environmental temperature during the molding of the housing sheath 17 may be relatively high, and the high temperature may cause damage to the control circuit 60 or the battery 70 contained in the circuit housing 30. The circuit housing 30 and the housing sheath 17 may be molded separately and assembled together to avoid the damage to the control circuit 60 or the battery 70 caused by the high temperature during the molding of the housing sheath 17, thereby reducing the damage to the control circuit 60 or the battery 70 caused by the molding. Further, the housing sheath 17 may have a bag-like structure with an open end, and the circuit housing 30 may enter the housing sheath 17 through the open end of the housing sheath 17.

In the present embodiment, after the housing sheath 17 is integrally formed with the protective sleeve 16 to form a whole structure, the whole structure may be removed from the mold by rolling the housing sheath 17 from the open end. When performing a visual inspection, a silk-screening, or other surface treatment for the housing sheath 17, the housing sheath 17 may be put on a preset structure through the opening for operation, and after the operation is completed, the housing sheath 17 may be rolled up and removed from the preset structure. After performing the operation, the housing sheath 17 may be coved on the periphery of the circuit casing 30 through the opening. In the above-mentioned operation, the removal of the housing sheath 17 from the mold is not limited to the above-mentioned rolling up method, and it may include inflated method, or the like, which is not limited herein.

Specifically, the opening of the housing sheath 17 may be disposed on an end of the housing sheath 17 away from the protective sleeve 16, and the circuit housing 30 may enter the inside of the housing sheath 17 from the end of the housing sheath 17 away from the protective sleeve 16 and covered by the housing sheath 17.

Figure 10:
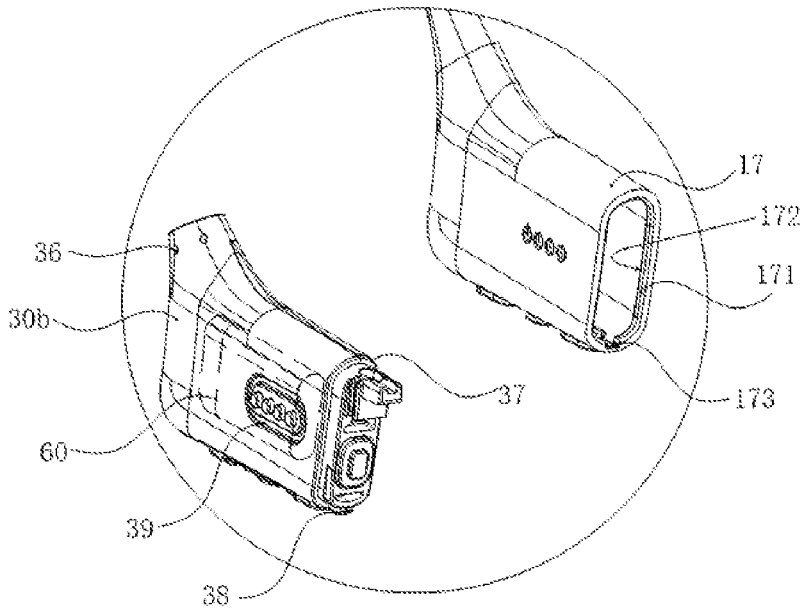
FIG. 10 is a schematic diagram illustrating a partial enlarged view of part E in FIG. 2.

FIG. 10 is a schematic diagram illustrating a partial enlarged view of part E in FIG. 2. Referring to FIG. 1 and FIG. 10, in some embodiments, the open end of the housing sheath 17 may include an annular flange 171 protruding inward. Further, the end of the circuit housing 30 away from the ear hook 10 may have a stepped structure, so as to form an annular table 37 (also referred to as a first annular table). The annular table 37 may be configured to connect with the annular flange 171 in a clamping manner for positioning the housing sheath. The annular flange 171 may abut on the annular table 37 when the housing sheath 17 covers the periphery of the circuit housing 30. In some embodiments, the annular flange 171 may be formed by the inner wall surface of the open end of the housing sheath 17 protruding to a certain thickness toward the inside of the housing sheath 17. The annular flange 171 may include a flange surface 172 facing the ear hook 10. The annular table 37 may be opposite to the flange surface 172 and toward a direction of the circuit housing 30 away from the ear hook 10. A height of the flange surface 172 of the annular flange 171 may be not greater than a height of the annular table 37, and the inner wall surface of the housing sheath 17 may abut the side wall of the circuit housing 30 and the housing sheath 17 may tightly cover the periphery of the circuit housing 30 when the flange surface 172 of the annular flange 171 abuts the annular table 37. In some embodiments, a sealant may be applied to a joint area between the annular flange 171 and the annular table 37. Specifically, when the housing sheath 17 is covered, the sealant may be coated on the annular table 37 to seal the housing sheath 17 and the circuit housing 30.

In some embodiments, the annular table 37 may include a positioning block 38. The positioning block 38 may be disposed on the annular table 37 and extend along a direction in which the circuit housing 30 is away from the ear hook 10. Specifically, the positioning block 38 may be disposed on the auxiliary sidewall 34 of the circuit housing 30, and a thickness of the positioning block 38 protruding on the auxiliary sidewall 34 may be consistent with the height of the annular table 37. The number of positioning blocks 38 may be set as one or more according to requirements. In some embodiments, the annular flange 171 of the housing sheath 17 may include a positioning groove 173 corresponding to the positioning block 38. The positioning groove 173 may be configured to accommodate at least a portion of the positioning block 38 for positioning the housing sheath 17. The positioning groove 173 may cover at least a portion of the positioning block 38 when the housing sheath 17 covers the periphery of the circuit housing 30. In such cases, when the housing sheath 17 is installed, the housing sheath 17 may be positioned according to positions of the positioning block 38 and the positioning groove 173, thereby improving accuracy and efficiency of the installation of the housing sheath 17. In some embodiments, the positioning block 38 may be omitted according to actual needs. In other embodiments, the positioning block 38 may also not be set according to actual needs.

Figure 11:
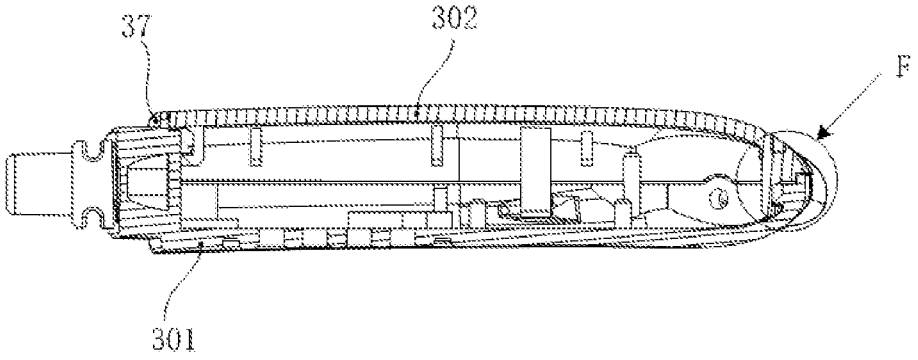
FIG. 11 is a schematic diagram illustrating a cross-sectional view of an exemplary circuit housing of an MP3 player according to some embodiments of the present disclosure.
Figure 12:
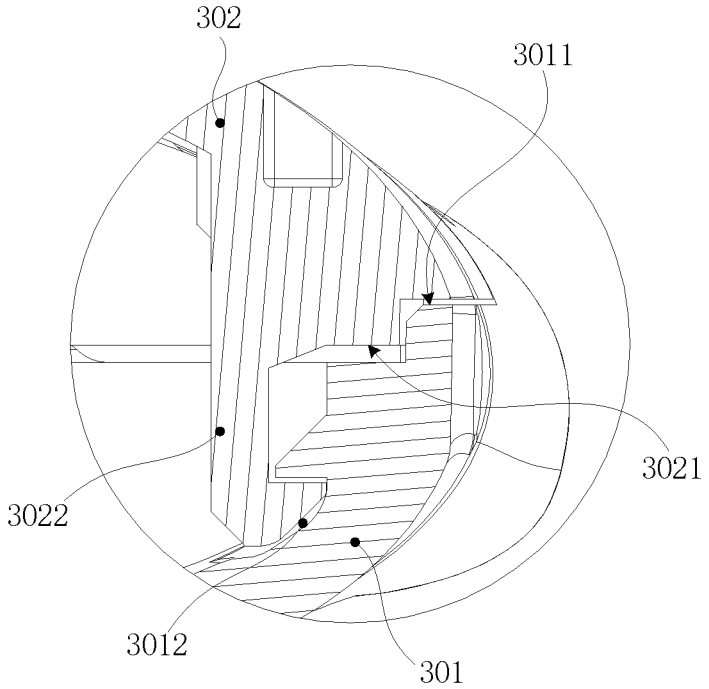
FIG. 12 is a schematic diagram illustrating a partial enlarged view of part F in FIG. 11.

FIG. 11 is a schematic diagram illustrating an exemplary core housing according to some embodiments of the present disclosure. FIG. 12 is a schematic diagram illustrating a partial enlarged view of part F in FIG. 11.

Referring to FIG. 2 and FIG. 11, in some embodiments, the circuit housing 30 may include a first sub-housing 301 and a second sub-housing 302 that may be connected to each other in a snap-fit connection. Specifically, the two sub-housings may be symmetrically snap-fitted along a center line of the circuit housing 30, or in other manners according to actual needs. In addition, the snap-fit connection of the two sub-housings of the circuit housing 30 for accommodating the control circuit 60 and the snap-fit connection of the two sub-housings of the circuit housing 30 for accommodating the battery 70 may be the same or different.

In some embodiments, the annular table 37 of the circuit housing 30 may be formed on the first sub-housing 301, and the two sub-housings may be joined on the side of the annular table 37 facing the ear hook 10, and the housing sheath 17 may cover a joint seam of the two sub-housings. An internal space of the circuit housing 30 may be sealed to a certain extent, thereby improving the waterproof effect of the MP3 player.

In some embodiments, the annular table 37 of the circuit housing 30 may be formed by the two sub-housings, and at least a portion of each of the two sub-housings may be combined on a side of the annular table 37 away from the ear hook 10. In this case, the housing sheath 17 may not cover the joint seam of the two sub-housings on the side of the annular table 37 away from the ear hook 10. In this application scenario, the joint seam may be further covered in other manners.

Referring to FIG. 2 and FIG. 12, in some embodiments, the joint surfaces of the two sub-housings abutting on each other may have stepped shapes that are mutually matched. Specifically, an end surface of the first sub-housing 301 facing the second sub-housing 302 may include a stepped first step surface 3011, and an end surface of the second sub-housing 302 facing the first sub-housing 301 may include a stepped second step surface 3021. The shapes and sizes of the first stepped surface 3011 and the second stepped surface 3021 may be the same, so that they can fit and abut each other. The joining surfaces of the two sub-housings of the circuit housing 30 abutting each other are stepped and not on a same plane, thereby preventing the liquid outside the circuit housing 30 from entering the circuit housing from the periphery of the circuit housing 30, improving the waterproof effect of the MP3 player, and protecting the control circuit 60 or the battery 70 inside the circuit housing 30.

In some embodiments, a mounting hook 3022 may be disposed on the second stepped surface 3021 of the second sub-housing 302, and the mounting hook 3022 may face the first sub-housing 30*a*. Correspondingly, the first sub-housing 301 may include a mounting groove 3012 matching the mounting hook 3022. When the first sub-housing 301 and the second sub-housing 302 are installed, the mounting hook 3022 may cross the outer side wall of the mounting groove 3012 under an action of an external force and enter the mounting groove 3012. A hook portion of the mounting hook 3022 may be hooked to the inner side wall of the hook groove 3012, thereby realizing the buckling of the first sub-housing 301 and the second sub-housing 302.

In some embodiments, a plurality of mounting holes may be disposed on the circuit housing 20. A first glue tank may be recessed on an outer surface of the circuit housing 20. The plurality of mounting holes may be disposed in the first glue tank. The speaker device may further include a plurality of conductive pillars. Each of the plurality of conductive pillars may be inserted into one mounting hole of the plurality of mounting holes. The housing sheath 17 may include one or more exposure holes configured to expose the plurality of conductive pillar. A sealant may be applied in the first glue tank to seal the housing sheath 17 and the circuit housing 20 on a periphery of the plurality of mounting holes.

In some embodiments, the speaker device may further include an auxiliary film. The auxiliary film may include a board. A hollow region may be disposed on the board. The board may be disposed on an inner surface of the circuit housing 20. The plurality of mounting holes may be disposed inside the hollow region to form a second glue tank on the periphery of the plurality of conductive pillars. A sealant may be applied in the second glue tank to seal the plurality of mounting holes and the circuit housing 20.

Figure 13:
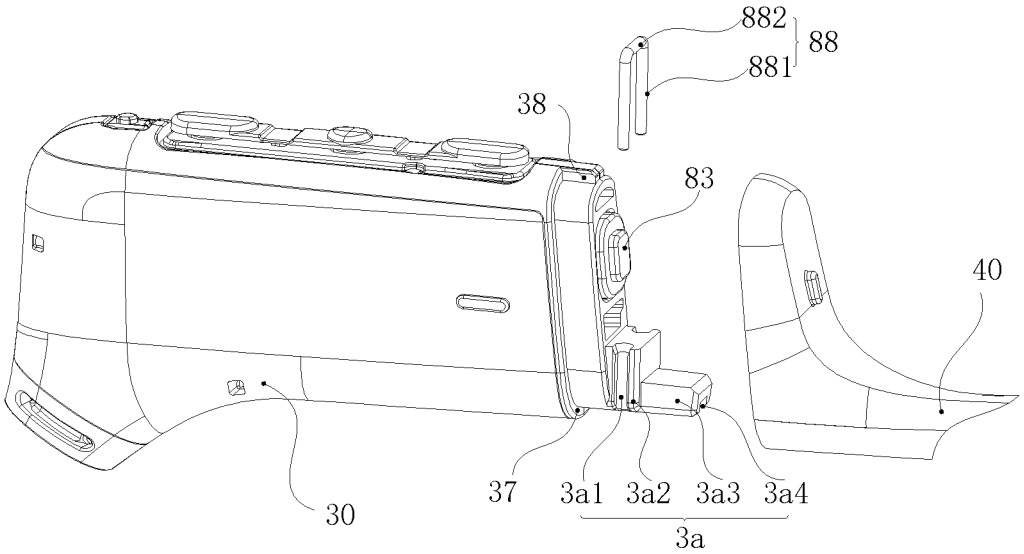
FIG. 13 is a schematic diagram illustrating an exploded view of partial structures of an exemplary circuit housing and an exemplary rear hook of an MP3 player according to some embodiments of the present disclosure.
Figure 14:
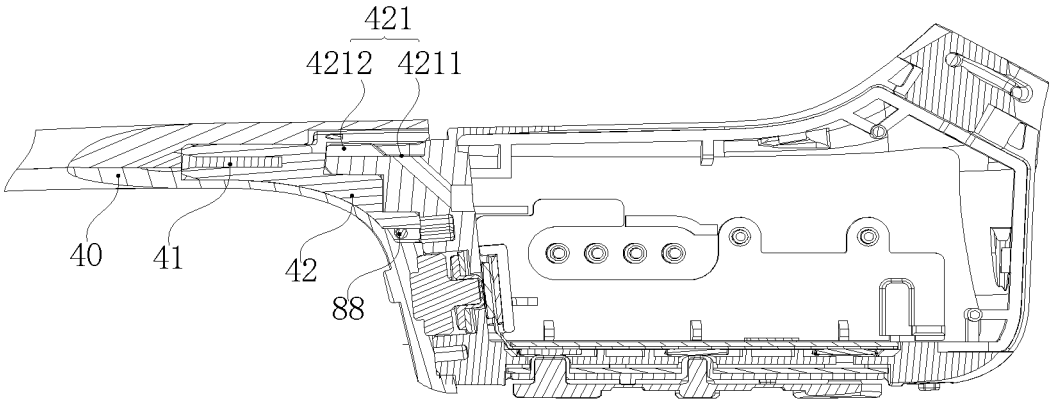
FIG. 14 is a schematic diagram illustrating a cross-section view of partial structures of an exemplary circuit housing and an exemplary rear hook of an MP3 player according to some embodiments of the present disclosure.
Figure 15:
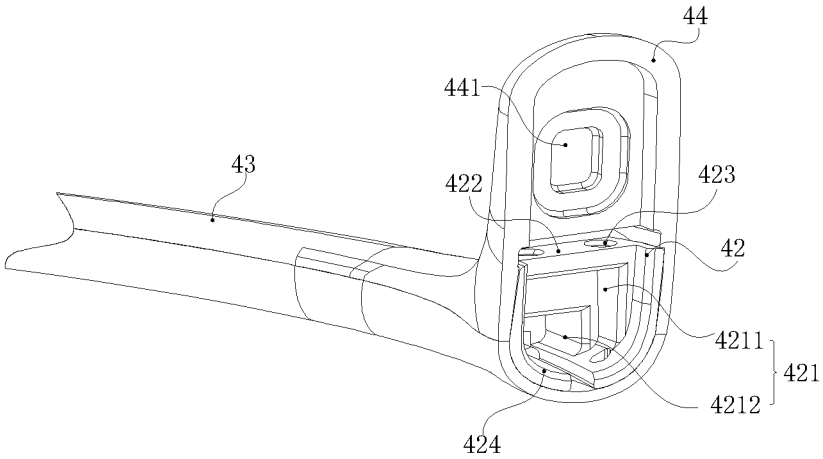
FIG. 15 is a schematic diagram illustrating a partial structure of an exemplary rear hook of an MP3 player according to some embodiments of the present disclosure.

FIG. 13 is a schematic diagram illustrating an exploded view of partial structures of an exemplary circuit housing and an exemplary rear hook of an MP3 player according to some embodiments of the present disclosure. FIG. 14 is a schematic diagram illustrating partial structures of an exemplary circuit housing and an exemplary rear hook according to some embodiments of the present disclosure. FIG. 15 is a schematic diagram illustrating a partial structure of an exemplary rear hook according to some embodiments of the present disclosure.

Referring to FIG. 2, FIG. 13, FIG. 14, and FIG. 15, in some embodiments, the circuit housing 30 may include a plug end 3*a* at an end of the circuit housing 30 away from the ear hook 10, and the rear hook 40 may include plug ends 42 disposed at two ends of an elastic metal wire 41. The plug end 3*a* and the plug end 42 may be fixedly plugged to each other.

Since the MP3 player includes two earphone cores 50 (i.e., a right earphone core and a left earphone core), the core housing 20 may include a right core housing and a right core housing correspondingly, and the circuit housing 30 may include a right circuit housing and a left circuit housing correspondingly. The rear hook 40 may be connected to the two circuit housings, respectively. The core housing 20, the ear hook 10, and the circuit housing 30 on both sides may be connected in a plug-in manner, and hung on the back of the user's head when the user wears a speaker device including the MP3 player. The plug end 42 may be formed at two ends of the elastic metal wire 41 by injection molding. Specifically, the plug end 42 may include plastic or other materials.

In some embodiments, the plug end 42 may include a socket 421, and the plug end 3*a* may be at least partially inserted into the socket 421. In this embodiment, the plug end 3*a* may be disposed on a side of the annular table 37 away from the ear hook 10. The connection manner between the plug end 3*a* and the socket 421 and the connection manner between the second plug end 15 and the second socket 31 may be the same or different.

In some embodiments, opposite sides of the plug end 3*a* may respectively include slots 3*a*1 perpendicular to the insertion direction of the plug end 3*a* with respect to the socket 421. The two slots 3*a*1 may be spaced and symmetrically disposed on two sides of the plug end 3*a*. Further, each of the two slots 3*a*1 may be communicated with a corresponding side wall of the plug end 3*a* in a direction perpendicular to the insertion direction.

In some embodiments, a first side wall 422 of the plug end 42 may include a through hole 423 corresponding to positions of the two slots 3*a*1. The plug end 42 may include a side wall configured to define a surrounding arrangement of the socket 421, and the first side wall 422 of the plug end 42 may be inserted between the plug end 3*a* and the plug end 42. The first side wall 422 of the plug end 42 may intersect with an extending direction of the slot 3*a*1 when the plug 3*a* is plugged with the plug 42.

The MP3 player may further include a fixing member 88. The fixing member 88 may include two parallel pins 881 and a connecting portion 882 configured to connect the pins 881. In the present embodiment, the connecting portion 812 may be vertically connected to ends of the two pins 881 at a same side, thereby forming a U-shaped fixing member 88, a shape of which may be the same as or similar to that of the fixing member 81. It should be noted that the shape of the fixing member 88 may be similar to that of the fixing member 81, size parameters of the fixing member 88 may be different from that of the fixing member 81 according to the surrounding structure. In this embodiment, a length of the pin 881 may be greater than that of the pin 811, and a length of the connecting portion 812 may be less than that of the connecting portion 882, which is not limited herein. In some embodiments, the pin 881 may be inserted into the slot 3*a*1 through the through hole 423 from the outside of the plug end 42, and the connecting portion 882 may be blocked from the outside of the plug end 3*a*, thereby realizing the connection between the plug end 42 and the plug end 3*a*.

By the above manner, the fixing member 88 of the MP3 player may include two pins 881 disposed in parallel and the connecting portion 882 for connecting the pins 881, so that the fixing member 88 may connect and fix the plug end 3*a* and the plug end 42 over a certain span, thereby improving the stability and reliability of the fixing between the circuit housing 30 and the rear hook 40. Further, the fixing member 88 may have a simple structure which may be convenient to insert and remove, so that the connection between the plug end 3*a* and the plug end 42 may be detachable, thereby improving the convenience of the assembly of the MP3 player. In some embodiments, the second side wall 424 of the plug end 42 opposite to the first side wall 422 of the plug end 42 may include one or more through holes 425 opposite to the through hole 423, and the pin 881 may pass through the slot 3*a*1 and insert into the through hole 425.

In the present embodiment, the pin 881 may pass through the slot 3*a*1 and insert into the through hole 425. That is, the pin 881 may connect the opposite side walls and the plug end of the plug end 42 of the rear hook 40 together, thereby improving the connection stability between the circuit housing 30 and the rear hook 40.

In some embodiments, the plug end 3*a* may be divided into a first plug section 3*a*2 and a second plug section 3*a*3 along the insertion direction of the plug end 3*a* relative to the socket 421. The plug end 3*a* may be disposed on the side of the end of the circuit housing 30 near the auxiliary side wall 34. The auxiliary side wall 34 may be another auxiliary sidewall 34 opposite to the auxiliary side wall 34 where the positioning block 38 is located.

In some embodiments, the first plug section 3*a*2 and the second plug section 3*a*3 may have a stepped shape along the insertion direction of the plug end 3*a* relative to the socket 421 on the side close to the positioning block 38. In a cross-sectional direction perpendicular to the insertion direction, the cross-section of the first plug section 3*a*2 may be larger than the cross-section of the second plug section 3*a*3.

Correspondingly, the socket 421 may be further divided into a first hole section 4211 and a second hole section 4212 whose shapes match the first plug section 3*a*2 and the second plug section 3*a*3 along the insertion direction of the socket end 3*a* relative to the socket 421. The plug end 3*a* may be inserted into the socket 421. The first plug section 3a2 and the second plug section 3a3 may be inserted into the first hole section 4211 and the second hole section 4212, respectively.

In some embodiments, the slot 3a1 may be disposed on the first plug section 3a2. Specifically, the slot 3a1 may be extended along the direction from the plug end 3a to the positioning block 38. That is, the direction in which the two auxiliary side walls 34 of the circuit housing 30 may be opposite to each other. The two side walls of the first plug section 3a2 perpendicular to the main side wall 33 of the circuit housing 30 may be penetrated. The two side walls of the first plug section 3a2 parallel to the main side wall 33 of the circuit housing 30 may be further penetrated in the vertical insertion direction.

The through hole 423 disposed on the plug end 42 may correspond to a side of the slot 3a1 facing the positioning block 38. The through hole 425 may correspond to the side of the slot 3a1 away from the positioning block 38.

In some embodiments, in one embodiment, top sides of the first plug section 3a2 and the second plug section 3a3 may be coplanar with each other. The top side of the first plug section 3a2 and the second plug section 3a3 refers to the side of the first plug section 3a2 and the second plug section 3a3 facing the top side of the head when the user normally wears the MP3 player. That is, the top side may be a side opposite to the stepped structure formed by the first plug section 3a2 and the second plug section 3a3.

In some embodiments, the top sides of the first plug section 3a2 and the second plug section 3a3 may be coplanar and formed a wiring slot 3a4 configured to accommodate a wire. The wiring slot 3a4 may extend along the insertion direction of the plug end 3a and the socket hole 421. The wiring slot 3a4 may be configured to accommodate the wires connecting the control circuit 60 and the battery 70 through the rear hook 40. In the present embodiment, the plug end 3a may be inserted into the socket 421. The slot 3a1 may be inserted from the side of the first plug section 3a2 facing the positioning block 38. Specifically, in the present embodiment, the plug end 3a may be disposed on a side of the circuit housing 30 facing the rear hook 40 away from the positioning block 38. Therefore, there may be a certain space on the side of the plug end 3a facing the positioning block 38. When the circuit housing 30 and the rear hook 40 are plugged in, the fixing component 88 may be removed from the bottom side of the first plug section 3a2. That is, the side of the first plug section 3a2 facing the positioning block 38 may be inserted into the slot 3a1 through the through-hole 423 and then into the through hole 425, thereby achieving the fixing of the circuit housing 30 and the rear hook 40. In this way, the fixing component 88 may be completely hidden in the internal space formed by the circuit housing 30 and the rear hook 40 without being exposed, thereby eliminating the need to occupy additional space.

In some embodiments, the rear hook 40 may further include a second protective sleeve 43 injection-molded on the periphery of the elastic metal wire 41 and the plug end 42 and an end protection cover 44 integrally formed with the second protective sleeve 43. The material of the second protective sleeve 43 and the end protective cover 44 may be the same as the material of the protective sleeve 16 and the housing sheath 17. The material of the protective sleeve 16 and the housing sheath 17 may include soft material with a certain elasticity, such as the soft silicone, the rubber, or the like, or any combination thereof.

The end protection cover 44 may be formed at two ends of the elastic metal wire 41. The end protection cover 44 may be integrally formed with the plug end 42 located at both ends of the elastic metal wire 41 on the periphery of the plug end 42. It should be noted that the housing sheath 17 is only wrapped by the end of the circuit housing 30 facing the ear hook 10 to the annular table 37 of the circuit housing 30. Therefore, the portion of the annular countertop 37 of the circuit housing 30 facing the rear hook 40 may be exposed from the periphery of the housing sheath 17. Further, in the present embodiment, the shape of the inner sidewall formed by the end protection cover 44 and the plug end 42 may match the shape of the exposed end of the circuit housing 30 to further cover the periphery of the end of the exposed the circuit housing 30. The end surface of the end protection cover 44 facing the circuit housing 30 and the end face of the housing sheath 17 facing the rear hook 40 may elastically abut, thereby providing the sealing.

It should be noted that the above description of the MP3 player is only a specific example and should not be regarded as the only feasible implementation solution. Obviously, for those skilled in the art, after understanding the basic principles of the MP3 player, various modifications and changes in forms and details of the specific methods and steps for implementing the MP3 player may be made without departing from the principles. For example, the shape of the first socket 22 may be an annular shape. The shape of the first socket 22 may also be an irregular annular shape (an inner wall of the first socket 22 is tooth). Such modifications are all within the protection scope of the present disclosure.

Figure 16:
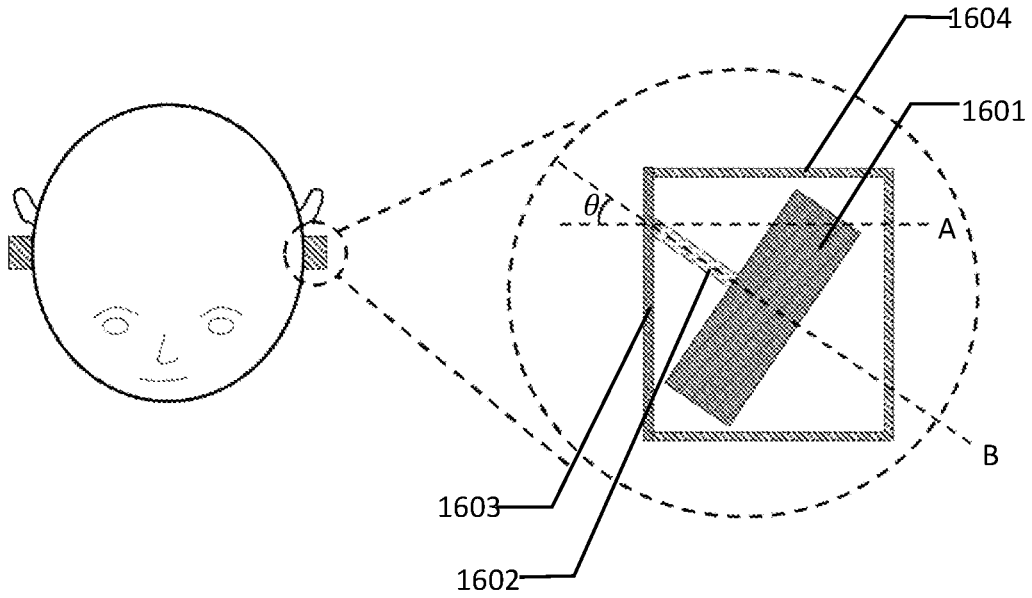
FIG. 16 is a schematic diagram illustrating an application scenario and a structure of an exemplary speaker device according to some embodiments of the present disclosure.

FIG. 16 is a schematic diagram illustrating an application scenario and a structure of an exemplary speaker device according to some embodiments of the present disclosure. Referring to FIG. 16 and FIG. 2, a housing 1604 in FIG. 11 may be equivalent to the core housing 20 in FIG. 2, and a driving device 1601 in FIG. 16 may be equivalent to the earphone core 50 in FIG. 2. In the following, a bone conduction speaker device may be taken as an example to describe the application scenario and the structure of the speaker device. In some embodiments, as shown in FIG. 16, a bone conduction speaker device may include a driving device 1601, a transmission assembly 1602, a panel 1603 (also referred to as a housing front panel, which is a side of the core housing 20 facing a user), and a housing 1604. In some embodiments, the housing 1604 may include a housing rear panel and a housing side, and the housing rear panel may be connected to the panel 1603 through the housing side. In some embodiments, the panel 1103 may be connected to the driving device 1101 (e.g., the headphone core) in a transmission connection manner. Specifically, the driving device 1601 may transmit a vibration signal to the panel 1603 and/or the housing 1604 through the transmission assembly 1602, so as to transmit sound to the human body of the user through the contact between the panel 1603 or the housing 1604 and the human skin of the user. In some embodiments, the panel 1603 and/or the housing 1604 of the bone conduction speaker device may be in contact with the human skin at the tragus, so as to transmit the sound to the human body. In some embodiments, the panel 1603 and/or the housing 1604 may be in contact with human skin on a back side of the auricle. In some embodiments, the driving device 1601 may cause the panel 1603 and the housing rear panel to vibrate.

In some embodiments, a line B (or a vibration direction of the driving device 1601) where a driving force generated by the driving device 1601 locates may form an angle θ with a normal line A of the panel 1603. That is, the line B and the normal line A of the panel 1603 may be unparallel. The panel 1603 may include an area, and the area may be in contact or abut against the human body (e.g., the human skin). It should be understood that the panel 1603 may be covered with other materials (e.g., a soft material such as silicone), thereby improving the wearing comfortability of the human body. In this case, the panel 1603 may be not in contact with the human body, and the panel 1603 may abut against the human body. In some embodiments, the entire panel 1603 may be in contact with the human body when the human body wears the bone conduction speaker device. In some embodiments, a portion of the panel 1603 may be in contact with the human body when the human body wears the bone conduction speaker device. In some embodiments, the area which may be in contact or abut against the human body may account more than 50% of an area of the panel 1603. In some embodiments, the area which may be in contact or abut against the human body may account for more than 60% of the area of the panel 1603. In general, the area which may be in contact or abut against the human body may include a flat surface, a curved surface, or the like, or any combination thereof.

In some embodiments, when the area on the panel 1603, which is in contact with or abuts against the human body is a flat surface, the normal line of the panel 1603 may be a dashed line perpendicular to the flat surface. In some embodiments, when the area on the panel 1603, which is in contact with or abuts against the human body, is a curved surface, the normal line of the panel 1603 may be an average normal line of the curved surface. The average normal line may be represented by Equation (1) below:

$$\hat{r}_0 = \frac{\oiint_S \hat{r}\, ds}{\left|\oiint_S \hat{r}\, ds\right|}, \tag{1}$$

wherein $\hat{r}_0$ represents an average normal line, $\hat{r}$ represents a normal line of a point on the curved surface, and ds represents a surface element.

Further, the curved surface may include a quasi-plane, which may be close to a plane, that is, an angle between a normal line of a point in at least 50% of the area of the curved surface, and the average normal may be less than an angle threshold. In some embodiments, the angle threshold may be less than 10°. In some embodiments, the angle threshold may be less than 5°.

In some embodiments, the line B where the driving force locates and the normal line A' of the area on the panel 1603, which is in contact with the human body, may form an angle θ. In some embodiments, a value of the angle θ may be between 0° and 180°. In some embodiments, the value of the angle θ may be between 0° and 180° and not equal to 90°. In some embodiments, assuming that the line B has a positive direction pointing out of the speaker device, and the normal line A of the panel 1603 (or the normal line A' of the area of the panel 1603, which is in contact with the human skin) also has a positive direction pointing out of the speaker device, the angle θ formed between the normal line A and the line B or between the normal line A' and the line B may be an acute angle along the positive direction, that is, the angle θ may be between 0° and 90°. More descriptions regarding the normal line A or the normal line A' may be found elsewhere in the present disclosure. See, e.g., FIG. 18 and the relevant descriptions thereof.

Figure 17:
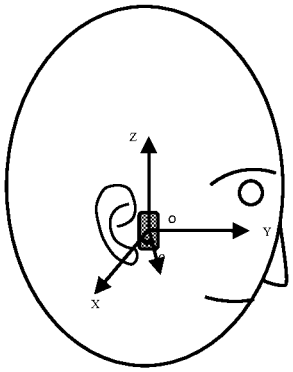
FIG. 17 is a schematic diagram illustrating an exemplary angle direction according to some embodiments of the present disclosure.

FIG. 17 is a schematic diagram illustrating an exemplary angle direction according to some embodiments of the present disclosure. As shown in FIG. 17, in some embodiments, a driving force generated by a driving device (e.g., the driving device 1101) may have a first component in a first quadrant of an XOY plane coordinate system and/or a second component in a third quadrant of the XOY plane coordinate system. The XOY plane coordinate system may include a reference coordinate system. An origin O of the XOY plane coordinate system may be located on a contact surface between a panel and/or a housing of a speaker device and the human body of a user who wears the speaker device. An X-axis of the XOY plane coordinate system may be parallel to a coronal axis of the human body. A Y-axis of the XOY plane coordinate system may be parallel to a sagittal axis of the human body. A positive direction of the X-axis may face outside of the human body, and a positive direction of the Y-axis may face the front of the human body. Quadrants refer to four regions divided by a horizontal axis (e.g., the X-axis of the XOY plane) and a vertical axis (e.g., the Y-axis of the XOY plane) in a rectangular coordinate system. Each of the four regions is called a quadrant. The quadrant may be centered at an origin, and the horizontal axis and the vertical axis may be regarded as dividing lines between the four regions. A relatively upper right region of the four regions (i.e., a region enclosed by a positive half axis of the horizontal axis and a positive half axis of the vertical axis) of the four regions may be regarded as a first quadrant. A relatively upper left region of the four regions (e.g., a region enclosed by a negative half axis of the horizontal axis and a positive half axis of the vertical axis) of the four regions may be regarded as a second quadrant. A relatively low left region (i.e., a region enclosed by the negative half axis of the horizontal axis and a negative half axis of the vertical axis) of the four regions may be regarded as a third quadrant. A relatively low right region (i.e., a region enclosed by the positive half axis of the horizontal axis and the negative half axis of the vertical axis) of the four regions may be regarded as a fourth quadrant. Each of points at a coordinate axis (e.g., the horizontal axis or the vertical axis) does not belong to any quadrant. It should be understood that a driving force in some embodiments may be located in the first quadrant and/or the third quadrant of the XOY plane coordinate system, or the driving force may be directed in other directions, a projection or a component of the driving force may be in the first quadrant and/or the third quadrant of the XOY plane coordinate system, and a projection or a component of the driving force in a Z-axis direction may be zero or not zero, wherein the Z-axis may be perpendicular to the XOY plane and pass through the origin O. In some embodiments, a relatively small angle θ between a line where the driving force locates and a normal line of an area of a panel of the speaker device, which is in contact with or abuts against the human body of the user may be any acute angle. For example, a range of the angle θ may be from 5° to 80°. In some embodiments, the range of the angle θ may be from 15° to 70°. In some embodiments, the range of the angle θ may be from 25° to 60°. In some embodiments, the range of the angle θ may be from 25° to 50°. In some embodiments, the range of the angle θ may be from 28° to 50°. In some embodiments, the range of the angle θ may be from 30 to 39°. In some embodiments, the range of the angle θ may be from 31° to 38°. In some embodiments, the range of the angle θ may be from 32° to 37°. In some embodiments, the range of the angle θ may be from 33° to 36°. In some embodiments, the range of the angle θ may be from 33° to 35.8°. In some embodiments, the range of the angle θ may be from 33.5° to 35°. In some embodiments, the angle θ may be 26°, 27°, 28°, 29°, 30°, 31°, 32°, 33°, 34°, 34.2°, 35°, 35.8°, 36°, 37°, 38°, etc., and an error of the angle θ may be controlled within 0.2°. It should be noted that the driving force described above should not be regarded as a limitation of the driving force in the present disclosure. In some other embodiments, the driving force may have one or more components in the second and/or the fourth quadrants of the XOY plane coordinate system. In some embodiments, the driving force may be located on the Y-axis.

Figure 18:
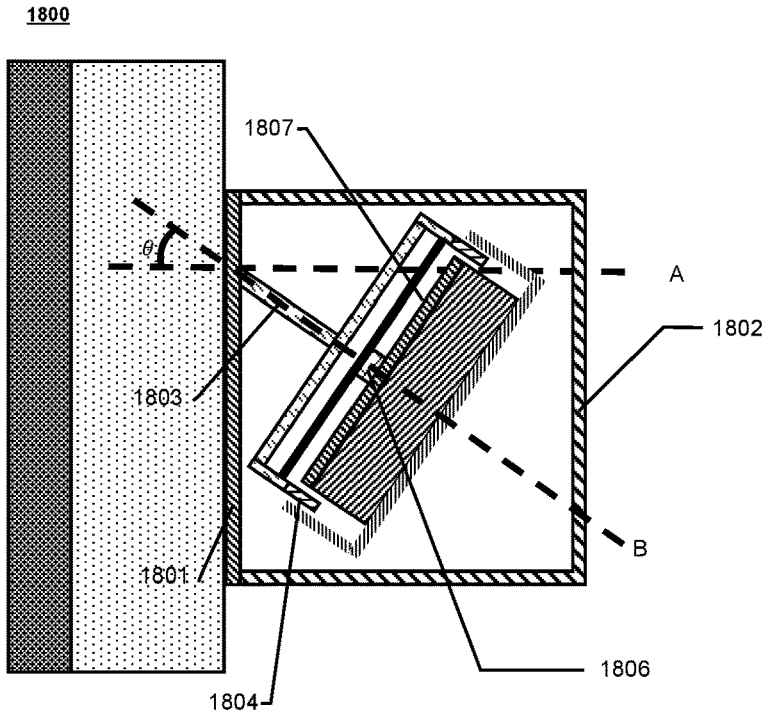
FIG. 18 is a schematic diagram illustrating an exemplary bone conduction speaker device acting on human skin or bones according to some embodiments of the present disclosure.

FIG. 18 is a schematic diagram illustrating an exemplary bone conduction speaker device acting on human skin or bones according to some embodiments of the present disclosure.

In some embodiments, a line where a driving force generated by a driving device (e.g., the driving device 1101) may be collinear or parallel to a line where the driving device vibrates. For example, a direction of a driving force may be the same as or opposite to a vibration direction of a coil and/or a magnetic circuit assembly based on a moving coil principle. A panel may include a flat surface or a curved surface. Alternatively, the panel may include a plurality of protrusions and/or grooves. In some embodiments, after the bone conduction speaker device is worn one the human body of a user, a normal line of an area on the panel that is in contact with or abuts against the human body may be unparallel to the line where the driving force locates. Generally, the area on the panel that is in contact with or abuts against the user's body may be relatively flat. Specifically, the area on the panel that is in contact with or abuts against the user's body may include a plane or a quasi-plane with a relatively small curvature. When the area on the panel configured to contact or abut against the human body is a plane, a normal line of a point on the area may be regarded as the normal line of the area. In this case, a normal line A of the panel 1603 and a normal line A' of the area of the panel 1603 contacted with the human skin of the user may be parallel or coincident with each other. When the area on the panel configured to contact the human body is non-planar, the normal line of the area may include an average normal line of the area. More descriptions regarding the average normal line may be found elsewhere in the present disclosure. See, e.g., FIG. 16 and the relevant descriptions thereof. In some other embodiments, when the area configured to contact the human body on the panel is non-planar, the normal line of the area may be determined according to the following operations. A point in the area of the panel may be determined. The area of the panel may contact with the human skin. A tangent plane of the panel at the point may be determined, and a line perpendicular to the tangent plane through the point may be determined, and the line may be regarded as the normal line of the panel. When the entire or a portion of the panel which is connected with the human skin is a non-planar, selected points may be different, tangent planes at the selected points may be different, and normal lines corresponding to the tangent planes may be different. In this case, the normal line A' of the normal lines may be unparallel to the normal A of the panel. According to some embodiments of the present disclosure, an angle θ may be formed between the line where the driving force locates (or the line where the driving device vibrates) and the normal line of the area, and the angle θ may be granter than 0 and less than 180°. In some embodiments, a direction of the driving force from the panel (or the contact surface of the panel and/or the housing connected with the human skin) to the outside of the speaker device may be assumed as a positive direction of the line where the driving force locates, a direction of the normal line pointing outward the panel (or a connect surface of the panel and/or the housing connected with the human skin) may be assumed as a positive direction of the normal line, accordingly, the angle θ may be an acute angle.

As shown in FIG. 18, the bone conduction speaker device may include the driving device (also referred to as a transducer device), a transmission assembly 1803, a panel 1801, and a housing 1802. In some embodiments, each of the coil 1804 and the magnetic circuit assembly 1807 may include an annular structure. In some embodiments, the driving device may adopt a moving coil type driving mode, and the driving device may include a coil 1804 and a magnetic circuit assembly 1807.

In some embodiments, an axis of the coil 1804 and an axis of the magnetic circuit assembly 1807 may be parallel to each other. The axis of the coil 1804 or the axis of the magnetic circuit assembly 1807 may be perpendicular to a radial plane of the coil 1804 and/or a radial plane of the magnetic circuit assembly 1807. In some embodiments, the coil 1804 and the magnetic circuit assembly 1807 may have the same central axis. The central axis of the coil 1804 may be perpendicular to the radial plane of the coil 1804 and pass through a geometric center of the coil 1804. The central axis may be vertical to the radial plane of the circuit assembly 1807, and the central axis of the magnetic circuit assembly 1807 may pass through the geometric center of the magnetic circuit assembly 1807. The axis of the coil 1804 or the axis of the magnetic circuit assembly 1807 and the normal line of the panel 1801 may form the aforementioned angle θ.

Merely by way of example, a relationship between the driving force F and skin deformation S may be described in connection with FIG. 18. When the line where the driving forced locates, which is generated by the driving device, is parallel to the normal line of the panel 1801 (i.e., the angle is equal to zero), the relationship between the driving force F and the total skin deformation S may be represented by Equation (2)

$$F_{\perp}=S_{\perp}\times E\times A/h, \tag{2}$$

wherein $F_{\perp}$ represents the driving force, $S_{\perp}$ represents the total skin deformation along a direction perpendicular to the skin, E represents an elastic modulus of the skin, A represents the contact area between the panel 1801 and the skin, and h represents a total thickness of the skin (i.e., a distance between the panel and the bone).

When the line where the driving force of the driving device locates is perpendicular to the normal of the area on the panel 1801, which is in contact with or abut against the user's body (i.e., the angle is 90°), the relationship between a driving force in the vertical direction and the total skin deformation may be represented by Equation (3) below:

$$F_{\parallel}=S_{\parallel}\times G\times A/h, \tag{3}$$

wherein $F_{\parallel}$ represents the driving force in the vertical direction, $S_{\parallel}$ represents a total skin deformation along a direction parallel to the skin, G represents a shear modulus of the skin, A represents the contact area between the panel 1801 and the skin, and h represents the total thickness of the skin (i.e., the distance between the panel and the bone).

A relationship between shear modulus and elastic modulus may be represented by Equation (4) below:

$$G=E/2(1+\gamma), \tag{4}$$

wherein γ represents the Poisson's ratio of the skin, $0<\gamma<0.5$, the shear modulus is less than the elastic modulus, and $S_{\parallel}>S_{\perp}$ under the same driving force. Generally, the Poisson's ratio of the skin may be close to 0.4.

When the line where the driving device locates is unparallel to the normal line of the area where the panel 1801 is in contact with the human body, a driving force along a horizontal direction and the driving force along the vertical direction may be represented by Equation (5) and Equation (6), respectively:

$$F_{\perp}=F\times\cos(\theta), \tag{5}$$

$$F_{\parallel}=F\times\sin(\theta), \tag{6}$$

wherein the relationship between driving force F and skin deformation s may be represented by Equation (7) below:

$$S=\sqrt[2]{S_{\perp}^2+S_{//}^2}=\frac{h}{A}\times F\times\sqrt[2]{(\cos(\theta)/E)^2+(\sin(\theta)/G)^2} \tag{7}$$

When the Poisson's ratio of the skin is 0.4, a relationship between the angle θ and the total skin deformation $S_{\perp}$ may be found elsewhere in the present disclosure.

Figure 19:
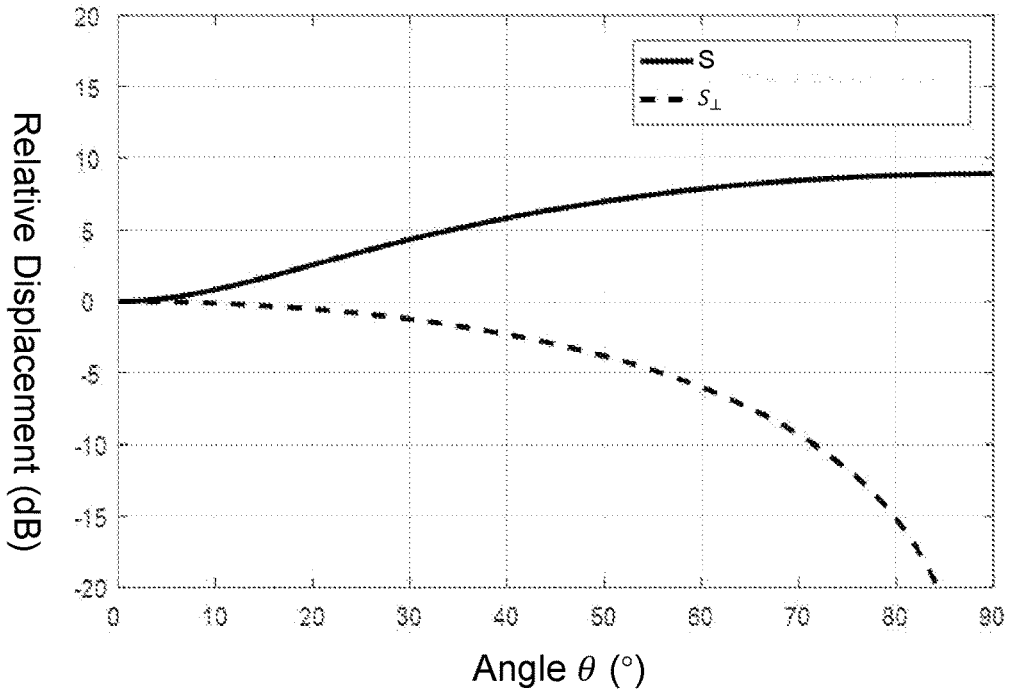
FIG. 19 is a schematic diagram illustrating a relationship between an angle and a relative displacement of an exemplary bone conduction speaker device according to some embodiments of the present disclosure.

FIG. 19 is a schematic diagram illustrating a relationship between an angle and a relative displacement of an exemplary bone conduction speaker device according to some embodiments of the present disclosure. As shown in FIG. 19, a relationship between an angle and a total deformation of the skin of a user may be that the greater the angle and/or the greater the relative displacement is, the greater the total deformation S is. A total skin deformation perpendicular to the skin $S_{\perp}$ may decrease as the angle θ increases, and/or as the relative displacement decreases. When the angle θ is close to 90°, the total skin deformation along a direction perpendicular to the skin $S_{\perp}$ may gradually tend to zero.

A part of a volume of the speaker device in a low frequency may have a positive correlation with the total skin deformation S. The greater the S is, the greater the part of the volume in the low frequency is. A part of the volume of the speaker device in a high frequency may have a positive correlation with the total skin deformation along the direction perpendicular to the skin $S_{\perp}$. The greater the total skin deformation along the direction perpendicular to the skin $S_{\perp}$ is, the greater the part of the volume in the high frequency is.

When the Poisson's ratio of the skin is 0.4, more descriptions regarding the relationship between the angle θ, the total skin deformation S, and the $S_{\perp}$ may be described in FIG. 19. As shown in FIG. 19, the relationship between the angle θ and the total skin deformation S may be that the greater the angle θ is, the greater the total skin deformation S is, and accordingly, the greater the part of the volume of the speaker device in the low frequency is. As shown in FIG. 19, the relationship between the angle θ and the total skin deformation along the direction perpendicular to the skin $S_{\perp}$ may be that the greater the angle θ is, the less the $S_{\perp}$ is, and accordingly, the less the part of the volume in the high frequency is.

As shown in Equation (7) and the curve in FIG. 19, an increasing speed of the total skin deformation S and a decreasing speed of the $S_{\perp}$ may be different. The increasing speed of the total skin deformation S may be from a relatively fast speed to a relatively slow speed. The decreasing speed of the $S_{\perp}$ may be faster and faster. The angle θ may be determined to balance the part of the volume of the speaker device in the low frequency and the part of the volume of the speaker device in the high frequency. For example, a range of the angle θ may be from 5° to 80°, from 15° to 70°, from 25° to 50°, from 25° to 35°, from 25° to 30°, or the like.

Figure 20:
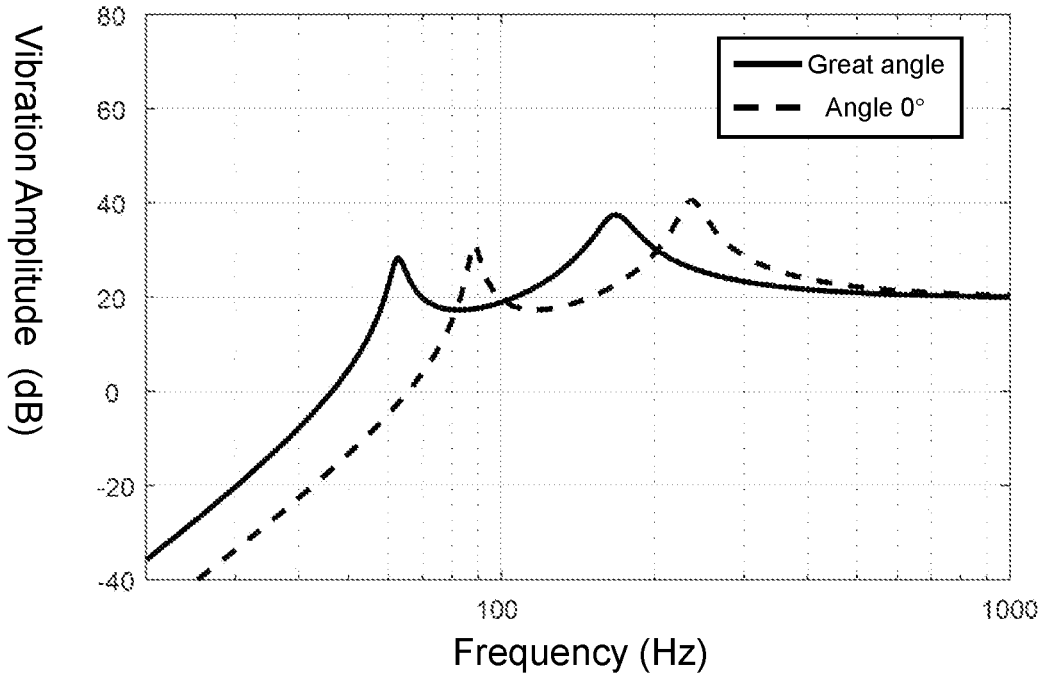
FIG. 20 is a schematic diagram illustrating a low frequency part of a frequency response curve of an exemplary bone conduction speaker device corresponding to different angles 8 according to some embodiments of the present disclosure.

FIG. 20 is a schematic diagram illustrating a low frequency part of a frequency response curve of an exemplary bone conduction speaker device corresponding to different angles 8 according to some embodiments of the present disclosure. As shown in FIG. 20, a panel is in contact with the skin of a user and transmits vibration to the skin. In this process, the skin may affect the vibration of the bone conduction speaker device, thereby affecting the frequency response curve of the bone conduction speaker device. As the descriptions described above, the greater the angle θ is, the greater the total skin deformation is under a same driving force. For the bone conduction speaker device, the total skin deformation may be equivalent to the reduction of the elasticity of the skin relative to the panel. It may be further understood that when a line where the driving force of the driving device locates and a normal line of an area of the panel, which is connected or abut against a user's body forms the angle θ. In particular, when the angle θ increases, a resonance peak of the low frequency part in the frequency response curve may be adjusted to a relatively low frequency part, thereby lowing the low frequency dive deeper and increasing the low frequency. Compared with other conventional techniques to improve the low-frequency components of a sound, for example, adding a vibration plate to the speaker device, setting the angle θ to improve the low frequency energy, and the like, may effectively reduce the vibration sense, further significantly improving the low frequency sensitivity of the bone conduction speaker device, the sound quality, and the human experience. It should be noted that, in some embodiments, the increased low frequency and the reduced vibration sense may be represented by that when the angle θ increases in the range from 0° to 90°, energy of the vibration or sound signal in the low frequency range may be increased, and the vibration sense may be increased. An increment of the energy in the low-frequency range may be greater than an increment of the vibration sense. For relative effects, the vibration sense may be relatively reduced. It may be seen from FIG. 20 that when the angle θ is relatively great, the resonance peak in the low frequency area may appear in a relatively low frequency range, which may extend a flat part of the frequency curvature in disguise, thereby improving the sound quality of the speaker device.

It should be noted that the illustration of the bone conduction speaker device described above is merely a specific example, and should not be regarded as the only feasible implementation. Obviously, for those skilled in the art, after understanding the basic principle of the bone conduction speaker device, it may be possible to make various modifications and changes in the forms and details of the specific methods and operations of implementing the bone conduction speaker device without departing from the principles, but these modifications and changes are still within the scope of the present disclosure. For example, a minimum angle θ between the line where the driving force of the driving device locates and the normal line of the area of the panel, which is connected or abut against a user's body (also referred to as the human body of a user), may be not limited to the range from 5° to 80° described above. Merely by way of example, the angle θ may be less than 5°, for example, 1°, 2°, 3°, 4°, or the like. In some other embodiments, the angle θ may be greater than 80° and less than 90°, for example, 81°, 82°, 85°, or the like. In some embodiments, a specific value of the angle θ may be not an integer (e.g., 81.3°, 81.38°, etc.). Such modifications, changes, and/or variations are all within the protection scope of the present disclosure.

Figure 21:
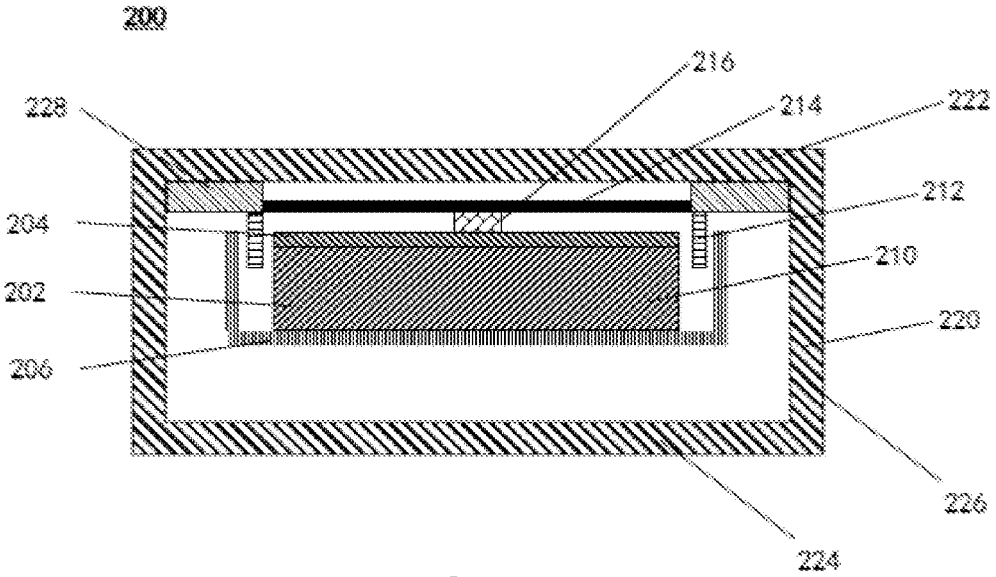
FIG. 21 is a schematic diagram illustrating a longitudinal cross-sectional view of an exemplary bone conduction speaker device according to some embodiments of the present disclosure.

FIG. 21 is a schematic diagram illustrating a longitudinal cross-sectional view of an exemplary bone conduction speaker device according to some embodiments of the present disclosure. It should be noted that the bone conduction speaker device 200 in FIG. 21 may correspond to the core housing 20 and the earphone core 50 in FIG. 2. The housing 220 may correspond to the core housing 20, and the multiple components in the housing 220 may correspond to the earphone core 50. As shown in FIG. 21, in some embodiments, the bone conduction speaker device 200 may include a magnetic circuit assembly 210, a coil 212, a vibration transmission plate 214, a connector 216, and a housing 220. The magnetic circuit assembly 210 may include a first magnetic unit 202, a first magnetically conductive unit 204, and a second magnetically conductive unit 206.

In some embodiments, the housing 220 may include a housing front panel 222, a housing rear panel 224, and a housing side panel 226. The housing rear panel 224 may be located on a side opposite to the housing front panel 222 and may be arranged on two ends of the housing side panel 226, respectively. The housing front panel 222, the housing rear panel 224, and the housing side panel 226 may form an integral structure with a certain accommodation space. In some embodiments, the magnetic circuit assembly 210, the coil 212, and the vibration transmission plate 214 may be fixed inside the housing 220. In some embodiments, the bone conduction speaker device 200 may further include a housing bracket 228. The vibration transmission plate 214 may be connected to the housing 220 via the housing bracket 228, and the coil 212 may be fixed on the housing bracket 228 and may drive the housing 220 to vibrate via the housing bracket 228. In some embodiments, the housing bracket 228 may be a part of the housing 220, or may be a separate component, directly or indirectly connected to the inside of the housing 220. In some embodiments, the housing bracket 228 may be fixed on an inner surface of the housing side panel 226. In some embodiments, the housing bracket 228 may be pasted on the housing 220 via an adhesive manner (e.g., using a glue), or may be fixed on the housing 220 in a stamping manner, an injection molding manner, a clamping manner, a riveting manner, a threaded manner, a welding manner, or the like, or any combination thereof.

In some embodiments, connection modes of the housing front panel 222, the housing rear panel 224, and the housing side panel 226 may be designed to ensure that the housing 220 has relatively large rigidity. For example, the housing front panel 222, the housing rear panel 224, and the housing side panel 226 may be integrally formed. As another example, the housing rear panel 224 and the housing side panel 226 may be an integral structure. The housing front panel 222 and the housing side panel 226 may be directly pasted and fixed using a glue, a clamping manner, a welding manner, a threaded manner, or the like, or any combination thereof. The glue may be with strong viscosity and high hardness. As a further example, the housing front panel 222 and the housing side panel 226 may be an integral structure, the housing rear panel 224 and the housing side panel 226 may be directly pasted and fixed in an adhesive manner (e.g., using a glue), a clamping manner, a welding manner, a threaded manner, or the like, or any combination thereof. In some embodiments, the housing front panel 222, the housing rear panel 224, and the housing side panel 226 may be independent components, which may be fixed in an adhesive manner (e.g., using a glue), a clamping manner, a welding manner, a threaded manner, or the like, or any combination thereof. For example, the housing front panel 222 and the housing side panel 226 may be connected by glue, the housing rear panel 224 and the housing side panel 226 may be connected in a clamping manner, a welding manner, or a threaded manner. Alternatively, the housing rear panel 224 and the housing side panel 226 may be connected by glue, and the housing front panel 222 and the housing side panel 226 may be connected in a clamping manner, a welding manner, or a threaded manner.

In different application scenarios, the housing illustrated in the present disclosure may be made by different assembly techniques. For example, as described elsewhere in the present disclosure, the housing may be integrally formed, and may also be formed in a separate combination manner, or a combination thereof. In the separate combination manner, different components may be fixed using a glue, or in a clamping manner, in a welding manner, in a threaded manner, or the like, or any combination thereof. Specifically, in order to better understand the assembly mode of the housing of the bone conduction earphone in the present disclosure, more descriptions regarding the assembly technique of the housing of the bone conduction speaker device may be found elsewhere in the present disclosure. See, e.g., FIGS. 22-24 and the relevant descriptions thereof.

Figure 22:
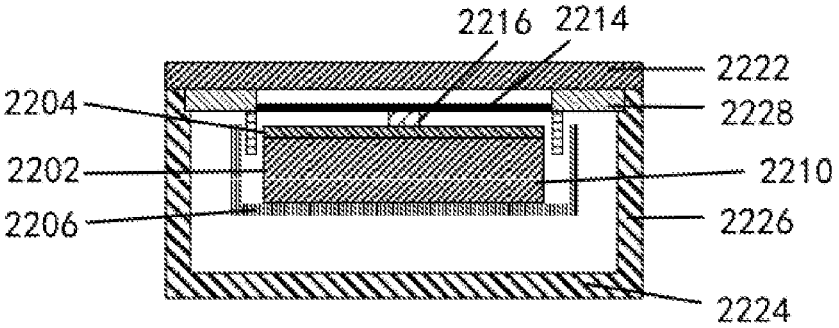
FIG. 22 is a schematic diagram illustrating an exemplary bone conduction speaker device according to some embodiments of the present disclosure.

As shown in FIG. 22, a bone conduction speaker device may include a magnetic circuit assembly 2210 and a housing. In some embodiments, the magnetic circuit assembly 2210 may include a first magnetic unit 2202, a first magnetically conductive unit 2204, and a second magnetically conductive unit 2206. The housing may include a housing front panel 2222, a housing rear panel 2224, and a housing side panel 2226. The housing side panel 2226 and the housing rear panel 2224 may be integrally formed, and the housing front panel 2222 may be connected to one end of the housing side panel 2226 in a separated combination manner. The separated combination manner may include a fixing manner with glue, or fixing the housing front panel 2222 to one end of the housing side panel 2226 in a clamping manner, a welding manner, a threaded manner. The housing front panel 2222 and the housing side panel 2226 (or the housing rear panel 2224) may include different, the same, or partially the same materials. In some embodiments, the housing front panel 2222 and the housing side panel 2226 may be made of the same material, and Young's modulus of the same material may be greater than 2000 MPa. In some embodiments, Young's modulus of the same material may be greater than 4000 MPa. In some embodiments, Young's modulus of the same material may be greater than 6000 MPa. In some embodiments, Young's modulus of the material of the housing 220 may be greater than 8000 MPa. In some embodiments, Young's modulus of the same material may be greater than 12000 MPa. In some embodiments, Young's modulus of the same material may be greater than 15000 MPa. In some embodiments, Young's modulus of the same material may be greater than 18000 MPa. In some embodiments, the housing front panel 2222 and the housing side panel 2226 may include different materials, and Young's modulus of the different materials may be greater than 4000 MPa. In some embodiments, Young's modulus of the different materials may be greater than 6000 MPa. In some embodiments, Young's modulus of the different materials may be greater than 8000 MPa. In some embodiments, Young's modulus of the different materials may be greater than 12000 MPa. In some embodiments, Young's modulus of the different materials may be greater than 15000 MPa. In some embodiments, Young's modulus of the different materials may be greater than 18000 MPa. In some embodiments, the material of the housing front panel 2222 and/or the housing side panel 2226 may include but not be limited to AcrYlonitrile butadiene stYrene (ABS), PolYstYrene (PS), high High impact polYstYrene (HIPS), PolYpropYlene (PP), PolYethYlene terephthalate (PET), PolYester (PES), PolYcarbonate (PC)), PolYamides (PA), PolYvinYl chloride (PVC), PolYurethanes (PU), PolYvinYlidene chloride (PVC), PolYethYlene (PE), PolYmethYl methacrYlate (PMMA), PolYetheretherketone (PEEK), Phenolics (PF), Urea-formaldehYde (UF), Melamine-formaldehYde (MF), metals, alloy (e.g., aluminum alloy, chromium-molybdenum steel, scandium alloy, magnesium alloy, titanium alloy, magnesium-lithium alloy, nickel alloy, etc.), glass fiber or carbon fiber, or the like, or any combination thereof. In some embodiments, the material of the housing front panel 2222 may include glass fiber, carbon fiber, Polycarbonate (PC), Polyamides (PA), or the like, or any combination thereof. In some embodiments, the material of the housing front panel 2222 and/or the housing side panel 2226 may be made by mixing carbon fiber and polycarbonate (PC) in a certain proportion. In some embodiments, the material of the housing front panel 2222 and/or the housing side panel 2226 may be made by mixing carbon fiber, glass fiber, and Polycarbonate (PC) in a certain proportion. In some embodiments, the material of the housing front panel 2222 and/or the housing side panel 2226 may be made by mixing glass fiber and Polycarbonate (PC) in a certain proportion, or may be made by mixing glass fiber and Polyamides (PA) in a certain proportion.

In some embodiments, the housing front panel 2222, the housing rear panel 2224, and the housing side panel 2226 may form an integral structure with a certain accommodation space. In the integral structure, the vibration transmission plate 2214 may be connected to the magnetic circuit assembly 2210 via the connector 2216. Two ends of the magnetic circuit assembly 2210 may be connected to the first magnetically conductive unit 2204 and the second magnetically conductive unit 2206, respectively. The vibration transmission plate 2214 may be fixed inside the integral structure via the housing bracket 2228. In some embodiments, the housing side panel 2226 may have a stepped structure for supporting the housing bracket 2228. After the housing bracket 2228 is fixed on the housing side panel 2226, the housing front panel 2222 may be fixed on the housing bracket 2228 and the housing side panel 2226, or fixed on the housing bracket 2228 and the housing side panel 2226, separately. In this case, alternatively, the housing side panel 2226 and the housing bracket 2228 may be integrally formed. In some embodiments, the housing bracket 2228 may be directly fixed on the housing front panel 2222 (e.g., using a glue, or in a clamping manner, a welding manner, a threaded manner, etc.). The fixed housing front panel 2222 and housing bracket 2228 may be then fixed to the housing side panel 2226 (e.g., using glue (also referred to as in an adhesive manner), or in a clamping manner, a welding manner, a threaded manner, etc.). In this case, alternatively, the outer casing 2228 and the outer casing 2222 may be integrally formed.

Figure 23:
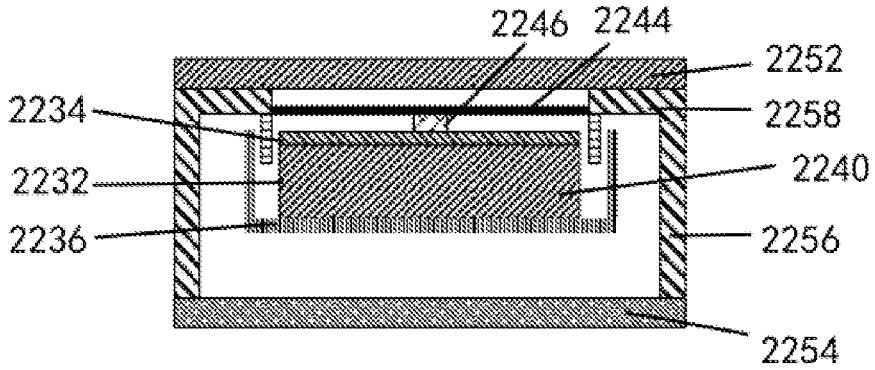
FIG. 23 is a schematic diagram illustrating another exemplary bone conduction speaker device according to some embodiments of the present disclosure.

In another specific embodiment, as shown in FIG. 23, a bone conduction speaker device may include a magnetic circuit assembly 2240 and a housing. The magnetic circuit assembly 2240 may include a first magnetic unit 2232, a first magnetically conductive unit 2234, and a second magnetically conductive unit 2236. In the integral structure, a vibration transmission plate 2244 may be connected to the magnetic circuit assembly 2240 via a connector 2246. Difference between the bone conduction speaker device illustrated in FIG. 23 and the bone conduction speaker device illustrated in FIG. 22 is that a housing bracket 2258 and the housing side panel 2256 of the bone conduction speaker device in FIG. 23 may be formed integrally. The housing front panel 2252 may be fixed to an end of the housing side panel 2256 connected to the housing bracket 2258 (e.g., in an adhesive manner, a clamping manner, a welding manner, a threaded manner, etc.), and the housing rear panel 2254 may be fixed to the other end of the housing side panel 2256 (e.g., in an adhesive manner, a clamping manner, a welding manner, a threaded manner, etc.). In this case, alternatively, the housing bracket 2258 and the housing side panel 2256 may be split and combined structures. The housing front panel 2252, the housing rear panel 2254, the housing bracket 2258, and the housing side panel 2256 may be fixedly connected in an adhesive manner, a clamping manner, a welding manner, a threaded manner, etc.

Figure 24:
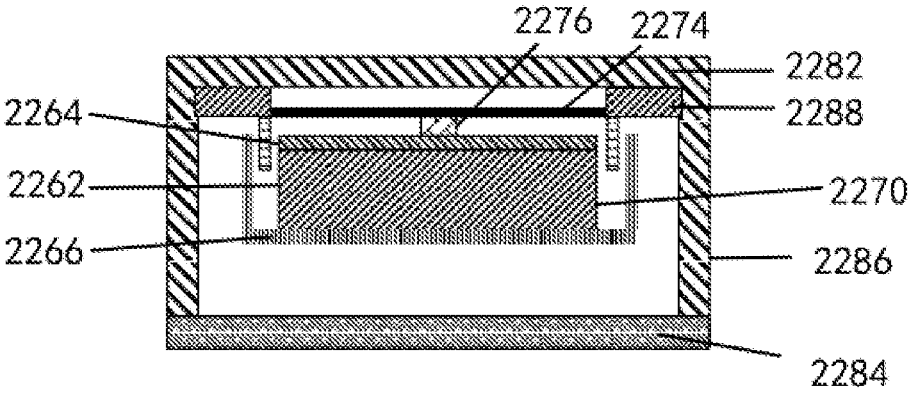
FIG. 24 is a schematic diagram illustrating a further exemplary bone conduction speaker device according to some embodiments of the present disclosure.

In another specific embodiment, as shown in FIG. 24, the bone conduction speaker may include a magnetic circuit assembly 2270 and a housing. The magnetic circuit assembly 2270 may include a first magnetic unit 2262, a first magnetically conductive unit 2264, and a second magnetically conductive unit 2266. In the integral structure, a vibration transmission plate 2274 may be connected to the magnetic circuit assembly 2270 via a connector 2276. Difference between the bone conduction speaker device illustrated in FIG. 24 and the bone conduction speaker device illustrated in FIG. 23 is that a housing front panel 2282 and a housing side panel 2286 of the conduction speaker device in FIG. 24 may be formed integrally. The housing rear panel 2284 may be fixed on an end of the housing side panel 2286 opposite to the housing side panel 2282 (e.g., in a glue manner, a clamping manner, a welding manner, a threaded manner, etc.). The housing bracket 2288 may be fixed on the housing front panel 2282 and/or the housing side 2286 in an adhesive manner, a clamping manner, a welding manner, or a threaded manner. In this case, alternatively, the housing bracket 2288, the housing front panel 2282, and the housing side panel 2286 may be formed integrally.

Figure 25:
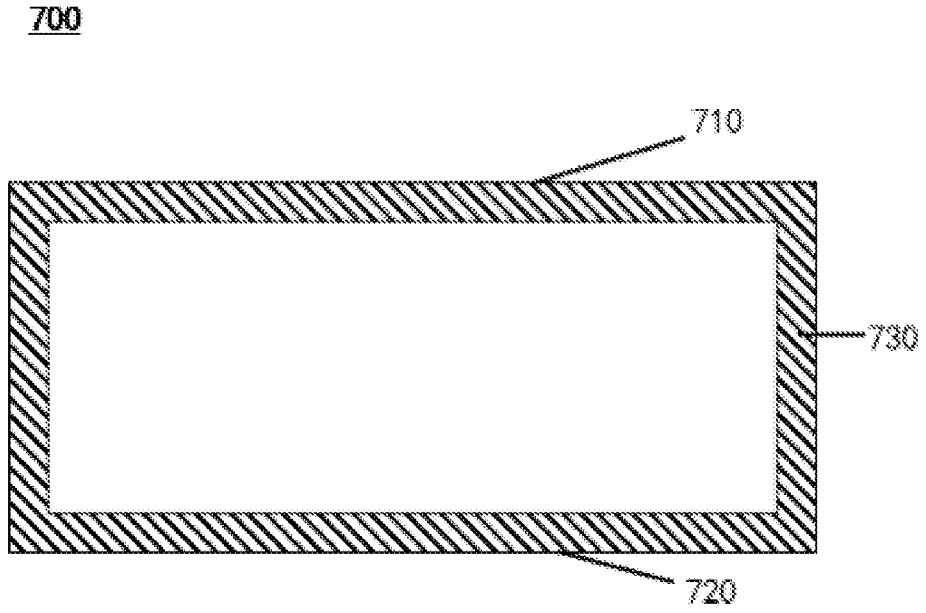
FIG. 25 is a schematic diagram illustrating a housing of an exemplary bone conduction speaker device according to some embodiments of the present disclosure.

FIG. 25 is a schematic diagram illustrating a housing of a bone conduction speaker device according to some embodiments of the present disclosure. As shown in FIG. 25, the housing 700 may include a housing front panel 710, a housing rear panel 720, and a housing side panel 730. The housing front panel 710 may be in contact with the human body of a user and transmit vibration of the bone conduction speaker device to the auditory nerve of the user. In some embodiments, the at least one of the housing front panel or the housing rear panel may be made of fiber-reinforced plastic material. In some embodiments, when an overall rigidity of the housing 700 is relatively large, vibration amplitudes and phases of the housing front panel 710 and those of the housing rear panel 720 may be the same or substantially the same (e.g., the housing side panel 730 may not compress air and may not generate sound leakage) within a certain frequency range, so that a first leaked sound signal generated by the housing front panel 710 and a second leaked sound signal generated by the housing rear panel 720 may overlap to reduce an amplitude of the first leaked sound wave or that of the second leaked sound wave, thereby reducing the sound leakage of the housing 700. In some embodiments, the certain frequency range may include at least a portion with a frequency greater than 500 Hz. In some embodiments, the certain frequency range may include at least a portion with a frequency greater than 600 Hz. In some embodiments, the certain frequency range may include at least a portion with a frequency greater than 800 Hz. In some embodiments, the certain frequency range may include at least a portion with a frequency greater than 1000 Hz. In some embodiments, the certain frequency range may include at least a portion with a frequency greater than 2000 Hz. In some embodiments, the certain frequency range may include at least a portion with a frequency greater than 5000 Hz. In some embodiments, the certain frequency range may include at least a portion with a frequency greater than 8000 Hz. In some embodiments, the certain frequency range may include at least a portion with a frequency greater than 10000 Hz.

In some embodiments, the rigidity of the housing 700 of the bone conduction speaker device may affect the vibration amplitudes and phases of different parts (e.g., the housing front panel 710, the housing rear panel 720, and/or the housing side panel 730) of the housing 700, thereby affecting the sound leakage of the bone conduction speaker device. In some embodiments, the housing front panel 710 and the housing rear panel 720 may have the same or substantially the same vibration amplitude and phase at a relatively high frequency, thereby reducing the sound leakage of the bone conduction speaker device significantly.

In some embodiments, the relatively high frequency may include a frequency not less than 1000 Hz, for example, a frequency between 1000 Hz and 2000 Hz, a frequency between 1100 Hz and 2000 Hz, a frequency between 1300 Hz and 2000 Hz, a frequency between 1500 Hz and 2000 Hz, a frequency between 1700 Hz and 2000 Hz, a frequency between 1900 Hz and 2000 Hz. In some embodiments, the relatively high frequency mentioned herein may include a frequency not less than 2000 Hz, for example, a frequency between 2000 Hz and 3000 Hz, a frequency between 2100 Hz and 3000 Hz, a frequency between 2300 Hz and 3000 Hz, a frequency between 2500 Hz and 3000 Hz, a frequency between 2700 Hz-3000 Hz, or a frequency between 2900 Hz-3000 Hz. In some embodiments, the relatively high frequency may include a frequency not less than 4000 Hz, for example, a frequency between 4000 Hz and 5000 Hz, a frequency between 4100 Hz and 5000 Hz, a frequency between 4300 Hz and 5000 Hz, a frequency between 4500 Hz and 5000 Hz, a frequency between 4700 Hz and 5000 Hz, or a frequency between 4900 Hz-5000 Hz. In some embodiments, the relatively high frequency may include a frequency not less than 6000 Hz, for example, a frequency between 6000 Hz and 8000 Hz, a frequency between 6100 Hz and 8000 Hz, a frequency between 6300 Hz and 8000 Hz, a frequency between 6500 Hz and 8000 Hz, a frequency between 7000 Hz and 8000 Hz, a frequency between 7500 Hz and 8000 Hz, or a frequency between 7900 Hz and 8000 Hz. In some embodiments, the relatively high frequency may include a frequency not less than 8000 Hz, for example, a frequency between 8000 Hz and 12000 Hz, a frequency between 8100 Hz and 12000 Hz, a frequency between 8300 Hz and 12000 Hz, a frequency between 8500 Hz and 12000 Hz, a frequency between 9000 Hz and 12000 Hz, a frequency between 10000 Hz and 12000 Hz, or a frequency between 11000 Hz and 12000 Hz.

The vibration amplitude of the housing front panel 710 (also referred to a first amplitude) and that of the housing rear panel 720 (also referred to a second amplitude) may be the same or substantially the same refers that a ratio of the vibration amplitude of the housing front panel 710 to that of the housing rear panel 720 may be within a certain range. For example, the ratio of the vibration amplitude of the housing front panel 710 to that of the housing rear panel 720 may be between 0.3 and 3. In some embodiments, the ratio of the vibration amplitude of the housing front panel 710 to that of the housing rear panel 720 may be between 0.4 and 2.5. In some embodiments, the ratio of the vibration amplitude of the housing front panel 710 to that of the housing rear panel 720 may be between 0.5 and 1.5. In some embodiments, the ratio of the vibration amplitude of the housing front panel 710 to that of the housing rear panel 720 may be between 0.6 and 1.4. In some embodiments, the ratio of the vibration amplitude of the housing front panel 710 to that of the housing rear panel 720 may be between 0.7 and 1.2. In some embodiments, the ratio of the vibration amplitude of the housing front panel 710 to that of the housing rear panel 720 may be between 0.75 and 1.15. In some embodiments, the ratio of the vibration amplitude of the housing front panel 710 to that of the housing rear panel 720 may be between 0.8 and 1.1. In some embodiments, the ratio of the vibration amplitude of the housing front panel 710 to that of the housing rear panel 720 may be between 0.9 and 1.05. In some embodiments, the vibrations of the housing front panel 710 and the housing rear panel 720 may be represented by other physical quantities that can characterize the vibration amplitude. For example, sound pressures generated by the housing front panel 710 and the housing rear panel 720 at a point in the space may be used to represent the vibration amplitudes of the housing front panel 710 and the housing rear panel 720.

The vibration phases of the housing front panel 710 and the housing rear panel 720 may be the same or substantially the same, which refers that a difference between the vibration phase of the housing front panel 710 and the vibration phase of the housing rear panel 720 may be within a certain range. For example, the difference between the vibration phases of the housing front panel 710 and the housing rear panel 720 may be between −90° and 90°. In some embodiments, the difference between the vibration phases of the housing front panel 710 and the housing rear panel 720 may be between −80° and 80°. In some embodiments, the difference between the vibration phases of the housing front panel 710 and the housing rear panel 720 may be between −60° and 60°. In some embodiments, the difference between the vibration phases of the housing front panel 710 and the housing rear panel 720 may be between −45° and 45°. In some embodiments, the difference between the vibration phases of the housing front panel 710 and the housing rear panel 720 may be between −30° and 30°. In some embodiments, the difference between the vibration phases of the housing front panel 710 and the housing rear panel 720 may be between −20° and 20°. In some embodiments, the difference between the vibration phases of the housing front panel 710 and the housing rear panel 720 may be between −15° and 15°. In some embodiments, the difference between the vibration phases of the housing front panel 710 and the housing rear panel 720 may be between −12° and 12°. In some embodiments, the difference between the vibration phases of the housing front panel 710 and the housing rear panel 720 may be between −10° and 10°. In some embodiments, the difference between the vibration phases of the housing front panel and the housing rear panel may be between −8° and 8°. In some embodiments, the difference between the vibration phases of the housing front panel and the housing rear panel may be between −6° and 6°. In some embodiments, the difference between the vibration phases of the housing front panel and the housing rear panel may be between −5° and 5°. In some embodiments, the difference between the vibration phases of the housing front panel and the housing rear panel may be between −4° and 4°. In some embodiments, the difference between the vibration phases of the housing front panel and the housing rear panel may be between −3° and 3°. In some embodiments, the difference between the vibration phases of the housing front panel 710 and the housing rear panel 720 may be between −2° and 2°. In some embodiments, the difference between the vibration phases of the housing front panel 710 and the housing rear panel 720 may be between −1° and 1°. In some embodiments, the difference between the vibration phases of the housing front panel 710 and the housing rear panel 720 may be 0°. In some embodiments, an absolute value of a difference between the first phase and the second phase may be less than 60°. For example, when a frequency of each of the vibration of the housing front panel and the vibration of the housing rear panel is between 2000 Hz and 3000 Hz, the absolute value of the difference between the first phase and the second phase may be 1°, 2°, 5°, 10°, 15°, 20°, 30°, 40°, 50°, 55°, 60°, etc.

It should be noted that the descriptions regarding the bone conduction speaker device described above are merely specific examples, and should not be regarded as the only feasible implementations. Obviously, for those skilled in the art, after understanding the basic principle of the bone conduction speaker device, it may be possible to make various modifications and changes in the forms and details of the specific methods and operations of implementing the bone conduction speaker device without departing from the principles, but these modifications and changes are still within the scope of the present disclosure. For example, the housing side panel 730, the housing rear panel 720, and the housing bracket may be formed integrally. Such modifications and/or changes are still within the protection scope of the present disclosure.

Figure 26:
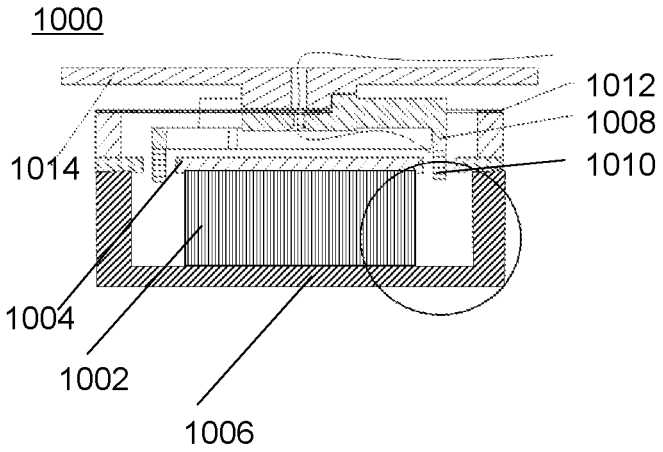
FIG. 26 is a schematic diagram illustrating a structure of an exemplary bone conduction speaker device according to some embodiments of the present disclosure.

FIG. 26 is a schematic diagram illustrating a longitudinal sectional view of an exemplary speaker device according to some embodiments of the present disclosure. As shown in FIG. 26, a speaker device 1000 may include a first magnetic unit 1002, a first magnetically conductive unit 1004, a second magnetically conductive unit 1006, a first vibration plate 1008, a voice coil 1010, a second vibration plate 1012, and a vibration panel 1014. One or more units of an earphone core of the speaker device 1000 may correspond to a magnetic circuit assembly. In some embodiments, the magnetic circuit assembly may include the first magnetic unit 1002, the first magnetically conductive unit 1004, and the second magnetically conductive unit 1006. The magnetic circuit assembly may generate a first total magnetic field (also referred to as "total magnetic field of the magnetic circuit assembly" or "first magnetic field").

The magnetic unit described in the present disclosure refers to a unit that generates a magnetic field, such as a magnet. The magnetic unit may have a magnetization direction. The magnetization direction refers to a direction of a magnetic field inside the magnetic unit. In some embodiments, the first magnetic unit 1002 may include one or more magnets. The first magnetic unit may generate a second magnetic field. In some embodiments, the magnet may include a metal alloy magnet, ferrite, or the like. The metal alloy magnet may include neodymium iron boron, samarium cobalt, aluminum nickel cobalt, iron chromium cobalt, aluminum iron boron, iron carbon aluminum, or the like, or any combination thereof. The ferrite may include barium ferrite, steel ferrite, manganese ferrite, lithium manganese ferrite, or the like, or any combination thereof.

In some embodiments, a lower surface of the first magnetically conductive unit 1004 may be connected to an upper surface of the first magnetic unit 1002. The second magnetically conductive unit 1006 may be connected to the first magnetic unit 1002. It should be noted that the magnetically conductive unit used herein refers to a magnetic field concentrator or an iron core. The magnetically conductive unit may adjust a distribution of a magnetic field (e.g., the second magnetic field generated by the first magnetic unit 1002). The magnetically conductive unit may include a unit made of a soft magnetic material. In some embodiments, the soft magnetic material may include a metal material, a metal alloy, a metal oxide material, an amorphous metal material, etc., such as iron, an iron-silicon alloy, an iron-aluminum alloy, a nickel-iron alloy, an iron-cobalt series alloy, a low carbon steel, a silicon steel sheet, a silicon steel sheet, a ferrite, etc. In some embodiments, the magnetically conductive unit may be processed by casting, plastic processing, cutting processing, powder metallurgy, or the like, or any combination thereof. The casting may include sand casting, investment casting, pressure casting, centrifugal casting, etc. The plastic processing may include rolling, casting, forging, stamping, extrusion, drawing, or the like, or any combination thereof. The cutting processing may include turning, milling, planning, grinding, or the like. In some embodiments, a processing mode of the magnetically conductive unit may include 3D printing, CNC machine tools, or the like. A connection manner between the first magnetically conductive unit 1004, the second magnetically conductive unit 1006, and the first magnetic unit 1002 may include an adhesive manner, a snap-fit manner, a welding manner, a riveting manner, a bolting manner, or the like, or any combination thereof. In some embodiments, the first magnetic unit 1002, the first magnetically conductive unit 1004, and the second magnetically conductive unit 1006 may be set as an axisymmetric structure. The axisymmetric structure may be an annular structure, a columnar structure, or other axisymmetric structures.

In some embodiments, a magnetic gap may form between the first magnetic unit 1002 and the second magnetically conductive unit 1006. The voice coil 1010 may be disposed in the magnetic gap. The voice coil 1010 may be connected to the first vibration plate 1008. The first vibration plate 1008 may be connected to the second vibration plate 1012. The second vibration plate 1012 may be connected to the vibration panel 1014. When a current is introduced into the voice coil 1010, the voice coil 1010 may be located in a magnetic field formed by the first magnetic unit 1002, the first magnetically conductive unit 1004, and/or the second magnetically conductive unit 1006, and may be applied to an ampere force. The ampere force may drive the voice coil 1010 to vibrate, and the vibration of the voice coil 1010 may drive the first vibration plate 1008, the second vibration plate 1012, and/or the vibration panel 1014 to vibrate. The vibration panel 1014 may transmit the vibration to the auditory nerve through tissues and bones, so that a person (e.g., a user of the speaker device) may hear a sound. The vibration panel 1014 may be in direct contact with human skins, or contact with the skins through a vibration transmission layer made of a specific material.

In some embodiments, for a speaker device with a single magnetic unit, magnetic induction line(s) passing through the voice coil may not be uniform and/or divergent. Magnetic leakage may be formed in the magnetic circuit. That is, more magnetic induction lines may leak outside the magnetic gap and fail to pass through the voice coil 1010. Magnetic induction intensity (or magnetic field intensity) at a position of the voice coil 1010 may decrease, which may affect the sensitivity of the speaker device. Thus, the speaker device 1000 may further include at least one second magnetic unit and/or at least one third magnetically conductive unit (not shown in FIG. 26). The at least one second magnetic unit and/or the at least one third magnetically conductive unit may be configured to suppress the leakage of a magnetic intensity of the first magnetic field and restrict a shape of the magnetic induction lines passing through the voice coil 1010. Relatively more magnetic induction lines may pass through the voice coil 1010 as horizontally and densely as possible to increase the magnetic induction intensity (or magnetic field intensity) at a position of the voice coil 1010, thereby increasing the sensitivity of the speaker device 1000, and further improving the mechanical conversion efficiency of the speaker device 1000 (e.g., the efficiency of converting the input power of the speaker device 1000 into the mechanical energy of the vibration of the voice coil).

Figure 27:
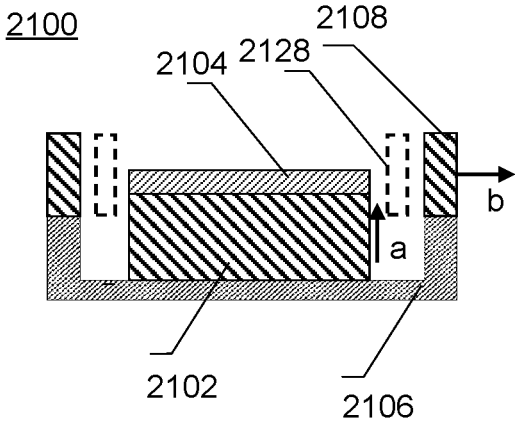
FIG. 27 is a schematic diagram illustrating a longitudinal sectional view of a magnetic circuit assembly 2100 according to some embodiments of the present disclosure.

FIG. 27 is a schematic diagram illustrating a longitudinal sectional view of a magnetic circuit assembly 2100 according to some embodiments of the present disclosure. As shown in FIG. 27, the magnetic circuit assembly 2100 may include a first magnetic unit 2102, a first magnetically conductive unit 2104, a second magnetically conductive unit 2106, and a second magnetic unit 2108. In some embodiments, the first magnetic unit 2102 and/or the second magnetic unit 2108 may include one or more magnets described in the present disclosure. In some embodiments, the first magnetic unit 2102 may include a first magnet, and the second magnetic unit 2108 may include a second magnet. The first magnet may be the same as or different from the second magnet. The first magnetically conductive unit 2104 and/or the second magnetically conductive unit 2106 may include one or more magnetically conductive materials described in the present disclosure. A processing manner of the first magnetically conductive unit 2104 and/or the second magnetically conductive unit 2106 may include one or more processing manners described in the present disclosure. In some embodiments, the first magnetic unit 2102 and/or the first magnetically conductive unit 2104 may be disposed as an axisymmetric structure. For example, a shape of the first magnetic unit 2102 and/or the first magnetically conductive unit 2104 may be a cylinder, a cuboid, or a hollow ring (e.g., a cross-section of the first magnetic unit 2102 and/or the first magnetically conductive unit 210 may be with a shape of a runway). In some embodiments, the first magnetic unit 2102 and the first magnetically conductive unit 2104 may be coaxial cylinders with the same or different diameters. In some embodiments, the second magnetically conductive unit 2106 may include a groove-type structure. The groove-type structure may include a U-shaped section (as shown in FIG. 26). The second magnetically conductive unit 2106 with the groove-type structure may include a bottom plate and at least one sidewall. In some embodiments, the bottom plate and the at least one sidewall may be integrally formed as a whole. For example, the sidewall may be formed by extending the bottom plate in a direction perpendicular to the bottom plate. In some embodiments, the bottom plate may be connected to the sidewall through one or more connection manners described in the present disclosure. The second magnetic unit 2108 may be disposed with an annular shape or a sheet shape. In some embodiments, the second magnetic unit 2108 may be disposed with an annular shape. The second magnetic unit 2108 may include an inner ring and an outer ring. In some embodiments, the second magnetic unit 2108 may surround the first magnetic unit 2102. In some embodiments, a shape of the inner ring and/or the outer ring may be a ring, an ellipse, a triangle, a quadrangle, or any other polygons. For example, the second magnetic unit 2108 may be formed by arranging a number of magnets. Both ends of one of the number of magnets may be connected to or have a certain distance from both ends of an adjacent magnet. The spacing between the magnets may be the same or different. In some embodiments, the second magnetic unit 2108 may be formed by arranging two or three sheet-shaped magnets equidistantly. The shape of the sheet-shaped magnet may include a fan-shape, a quadrangular shape, or the like. In some embodiments, the second magnetic unit 2108 may be coaxial with the first magnetic unit 2102 and/or the first magnetically conductive unit 2104.

In some embodiments, an upper surface of the first magnetic unit 2102 may be connected to a lower surface of the first magnetically conductive unit 2104. The lower surface of the first magnetic unit 2102 may be connected to the bottom plate of the second magnetically conductive unit 2106. The lower surface of the second magnetic unit 2108 may be connected to the sidewall of the second magnetically conductive unit 2106. A connection manner between the first magnetic unit 2102, the first magnetically conductive unit 2104, the second magnetically conductive unit 2106, and/or the second magnetic unit 2108 may include an adhesive manner, a snap-fit manner, a welding manner, a riveting manner, a bolting manner, or the like, or any combination thereof.

In some embodiments, a magnetic gap may be formed between the first magnetic unit 2102 and/or the first magnetically conductive unit 2104 and the inner ring of the second magnetic unit 2108. A voice coil 2128 may be disposed in the magnetic gap. In some embodiments, a height of the second magnetic unit 2108 and a height of the voice coil 2128 relative to the bottom plate of the second magnetically conductive unit 2106 may be equal. In some embodiments, the first magnetic unit 2102, the first magnetically conductive unit 2104, the second magnetically conductive unit 2106, and the second magnetic unit 2108 may form a magnetic circuit. In some embodiments, the magnetic circuit assembly 2100 may generate a first total magnetic field (also referred to as "total magnetic field of magnetic circuit assembly" or "first magnetic field"). The first magnetic unit 2102 may generate a second magnetic field. The first total magnetic field may be formed by magnetic fields generated by all components (e.g., the first magnetic unit 2102, the first magnetically conductive unit 2104, the second magnetically conductive unit 2106, and/or the second magnetic unit 2108) in the magnetic circuit assembly 2100. Magnetic field strength (also referred to as magnetic induction intensity, magnetic field intensity, or magnetic flux density) of the first total magnetic field in the magnetic gap may be greater than magnetic field intensity of the second magnetic field in the magnetic gap. In some embodiments, the second magnetic unit 2108 may generate a third magnetic field. The third magnetic field may increase the magnetic field intensity of the first total magnetic field in the magnetic gap. The third magnetic field increasing the magnetic field intensity of the first total magnetic field herein refers to that the magnetic intensity of the first total magnetic field in the magnetic gap when the third magnetic field exists (e.g., the second magnetic unit 2108 exists) may be greater than that of the first total magnetic field when the third magnetic field does not exist (e.g., the second magnetic unit 2108 does not exist). In other embodiments in the present disclosure, unless otherwise specified, the magnetic circuit assembly refers to a structure including all magnetic units and magnetically conductive units. The first total magnetic field may represent the magnetic field generated by the magnetic circuit assembly as a whole. The second magnetic field, the third magnetic field, . . . , and the $N^{th}$ magnetic field may respectively represent a magnetic field generated by a corresponding magnetic unit. In some embodiments, the magnetic unit that generates the second magnetic field (e.g., the third magnetic field, . . . , or the $N^{th}$ magnetic field) may be the same or different.

In some embodiments, an included angle between a magnetization direction of the first magnetic unit 2102 and a magnetization direction of the second magnetic unit 2108 may be between 0 degrees and 180 degrees. In some embodiments, the included angle between the magnetization direction of the first magnetic unit 2102 and the magnetization direction of the second magnetic unit 2108 may be between 45 degrees and 135 degrees. In some embodiments, the induced angle between the magnetization direction of the first magnetic unit 2102 and the magnetization direction of the second magnetic unit 2108 may be equal to or greater than 90 degrees. In some embodiments, the magnetization direction of the first magnetic unit 2102 may be perpendicular to the lower surface or the upper surface of the first magnetic unit 2102 and be vertically upward (a direction as indicated by an arrow a in FIG. 27). The magnetization direction of the second magnetic unit 2108 may be directed from the inner ring of the second magnetic unit 2108 to the outer ring of the second magnetic unit 2108 (e.g., a direction as indicated by an arrow b on a right side of the first magnetic unit 2102 in FIG. 27, the magnetization direction of the first magnetic unit 2102 may deflect 90 degrees in a clockwise direction).

In some embodiments, at a position of the second magnetic unit 2108, an included angle between the direction of the first total magnetic field and the magnetization direction of the second magnetic unit 2108 may be not greater than 90 degrees. In some embodiments, at the position of the second magnetic unit 2108, the included angle between the direction of the magnetic field generated by the first magnetic unit 2102 and the direction of the magnetization of the second magnetic unit 2108 may be less than or equal to 90 degrees, such as 0 degrees, 10 degrees, 20 degrees, or the like.

Compared with a magnetic circuit assembly with a single magnetic unit, the second magnetic unit 2108 may increase the total magnetic flux in the magnetic gap of the magnetic circuit assembly 2100, thereby increasing the magnetic induction intensity in the magnetic gap. Further, under an action of the second magnetic unit 2108, originally scattered magnetic induction lines may converge to the position of the magnetic gap, which may further increase the magnetic induction intensity in the magnetic gap.

Figure 28:
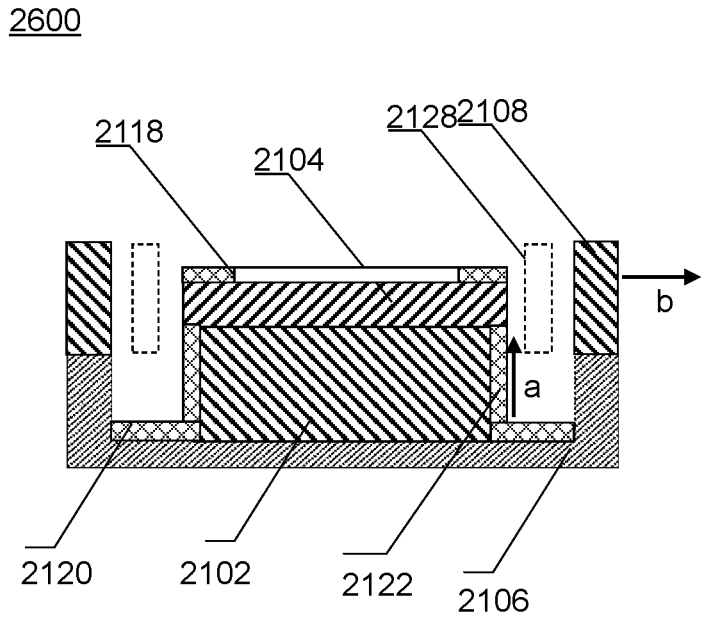
FIG. 28 is a schematic diagram illustrating a longitudinal sectional view of a magnetic circuit assembly 2600 according to some embodiments of the present disclosure.

FIG. 28 is a schematic diagram illustrating a longitudinal sectional view of a magnetic circuit assembly 2600 according to some embodiments of the present disclosure. As shown in FIG. 28, different from the magnetic circuit assembly 2100 shown in FIG. 27, the magnetic circuit assembly 2600 may include at least one electrically conductive unit (e.g., a first electrically conductive unit 2118, a second electrically conductive unit 2120, and a third electrically conductive unit 2122).

The at least one electrically conductive unit may include a metal material, a metal alloy material, an inorganic non-metal material, or other conductive materials. The metal material may include gold, silver, copper, aluminum, etc. The metal alloy material may include an iron-based alloy, an aluminum-based alloy material, a copper-based alloys, a zinc-based alloys, etc. The inorganic non-metal material may include graphite, etc. The at least one electrically conductive unit may include a sheet shape, an annular shape, a mesh shape, or the like. The first electrically conductive unit 2118 may be disposed on an upper surface of the first magnetically conductive unit 2104. The second electrically conductive unit 2120 may be connected to the first magnetic unit 2102 and the second magnetically conductive unit 2106. The third electrically conductive unit 2122 may be connected to a sidewall of the first magnetic unit 2102. In some embodiments, the first magnetically conductive unit 2104 may protrude from the first magnetic unit 2102 to form a first concave portion. The third electrically conductive unit 2122 may be disposed on the first concave portion. In some embodiments, the first electrically conductive unit 2118, the second electrically conductive unit 2120, and the third electrically conductive unit 2122 may include the same or different conductive materials. The first electrically conductive unit 2118, the second electrically conductive unit 2120, and/or the third electrically conductive unit 2122 may be respectively connected to the first magnetically conductive unit 2104, the second magnetically conductive unit 2106 and/or the first magnetic unit 2102 in one or more connection manners described in the present disclosure.

A magnetic gap may be formed between the first magnetic unit 2102, the first magnetically conductive unit 2104, and the inner ring of the second magnetic unit 2108. A voice coil 2128 may be disposed in the magnetic gap. The first magnetic unit 2102, the first magnetically conductive unit 2104, the second magnetically conductive unit 2106, and the second magnetic unit 2108 may form a magnetic circuit. In some embodiments, the electrically conductive unit may reduce an inductive reactance of the voice coil 2128. For example, if a first alternating current flows through the voice coil 2128, a first alternating induced magnetic field may be generated near the voice coil 2128. Under an action of the magnetic field in the magnetic circuit, the first alternating induced magnetic field may cause the voice coil 2128 to generate the inductive reactance, thereby hindering a movement of the voice coil 2128. When an electrically conductive unit (e.g., the first electrically conductive unit 2118, the second electrically conductive unit 2120, and/or the third electrically conductive unit 2122) is disposed near the voice coil 2128, the electrically conductive unit may induce a second alternating current under the action of the first alternating induced magnetic field. A third alternating current in the electrically conductive unit may generate a second alternating induced magnetic field near the third alternating current. A direction of the second alternating induction magnetic field may be opposite to that of the first alternating induction magnetic field, thereby weakening the first alternating induction magnetic field, reducing the inductive reactance of the voice coil 2128, increasing the current in the voice coil, and improving the sensitivity of a speaker device.

Figure 29:
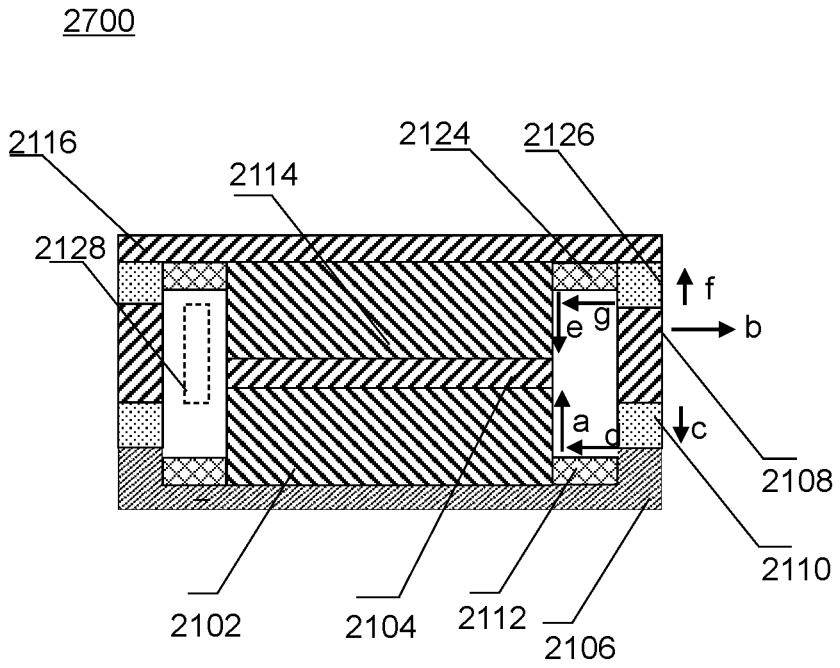
FIG. 29 is a schematic diagram illustrating a longitudinal sectional view of a magnetic circuit assembly 2700 according to some embodiments of the present disclosure.

FIG. 29 is a schematic diagram illustrating a longitudinal sectional view of a magnetic circuit assembly 2700 according to some embodiments of the present disclosure. As shown in FIG. 29, different from the magnetic circuit assembly 2600 shown in FIG. 28, the magnetic circuit assembly 2700 may include a third magnetic unit 2110, at least one fourth magnetic unit 2112, a fifth magnetic unit 2114, a third magnetically conductive unit 2116, a sixth magnetic unit 2124, and a seventh magnetic unit 2126. The third magnetic unit 2110, the fourth magnetic unit 2112, the fifth magnetic unit 2114, the third magnetically conductive unit 2116, the sixth magnetic unit 2124, and/or the seventh magnetic unit 2126 may be disposed as coaxial annular cylinders.

In some embodiments, an upper surface of the second magnetic unit 2108 may be connected to the seventh magnetic unit 2126. A lower surface of the second magnetic unit 2108 may be connected to the third magnetic unit 2110. The third magnetic unit 2110 may be connected to the second magnetically conductive unit 2106. An upper surface of the seventh magnetic unit 2126 may be connected to the third magnetically conductive unit 2116. The fourth magnetic unit 2112 may be connected to the second magnetically conductive unit 2106 and the first magnetic unit 2102. The at least one fifth magnetic unit 2114 may be connected to an upper surface of the first magnetically conductive unit 2104. The third magnetically conductive unit 2116 may be connected to an upper surface of the fifth magnetic unit 2114. The sixth magnetic unit 2124 may be connected to the fifth magnetic unit 2114, the third magnetically conductive unit 2116, and the seventh magnetic unit 2126. In some embodiments, the first magnetic unit 2102, the first magnetically conductive unit 2104, the second magnetically conductive unit 2106, the second magnetic unit 2108, the third magnetic unit 2110, the fourth magnetic unit 2112, the fifth magnetic unit 2114, the third magnetically conductive unit 2116, the sixth magnetic unit 2124, and the seventh magnetic unit 2126 may form a magnetic circuit and a magnetic gap. The fourth magnetic unit 2112 may be disposed below the magnetic gap.

In some embodiments, an included angle between a magnetization direction of the first magnetic unit 2102 and a magnetization direction of the sixth magnetic unit 2124 may be between 0 degrees and 180 degrees. In some embodiments, the included angle between the magnetization direction of the first magnetic unit 2102 and the magnetization direction of the sixth magnetic unit 2124 may be between 45 degrees and 135 degrees. In some embodiments, the included angle between the magnetization direction of the first magnetic unit 2102 and the magnetization direction of the sixth magnetic unit 2124 may not be greater than 90 degrees. In some embodiments, the magnetization direction of the first magnetic unit 2102 may be perpendicular to a lower surface or an upper surface of the first magnetic unit 2102 and be vertically upward (e.g., a direction indicated by an arrow a in the FIG. 29). The magnetization direction of the sixth magnetic unit 2124 may be directed from an outer ring of the sixth magnetic unit 2124 to an inner ring (e.g., a direction indicated by an arrow g on a right side of the first magnetic unit 2102 in the FIG. 29, the magnetization direction of the first magnetic unit 2102 may deflect 270 degrees in a clockwise direction). In some embodiments, the magnetization direction of the sixth magnetic unit 2124 may be the same as that of the fourth magnetic unit 2112 along a same vertical direction.

In some embodiments, at a position of the sixth magnetic unit 2124, an included angle between a direction of a magnetic field generated by the magnetic circuit assembly 2700 and the magnetization direction of the sixth magnetic unit 2124 may not be greater than 90 degrees. In some embodiments, at the position of the sixth magnetic unit 2124, the included angle between the direction of the magnetic field generated by the first magnetic unit 2102 and the magnetized direction of the sixth magnetic unit 2124 may be less than or equal to 90 degrees, such as 0 degrees, 10 degrees, or 20 degrees.

In some embodiments, the included angle between the magnetization direction of the first magnetic unit 2102 and a magnetization direction of the seventh magnetic unit 2126 may be between 0 degrees and 180 degrees. In some embodiments, the included angle between the magnetization direction of the first magnetic unit 2102 and the magnetization direction of the seventh magnetic unit 2126 may be between 45 degrees and 135 degrees. In some embodiments, the included angle between the magnetization direction of the first magnetic unit 2102 and the magnetization direction of the seventh magnetic unit 2126 may not be higher than 90 degrees. In some embodiments, the magnetization direction of the first magnetic unit 2102 may be perpendicular to a lower surface or an upper surface of the first magnetic unit 2102 and be vertically upward (e.g., a direction indicated by the arrow a in FIG. 29). The magnetization direction of the seventh magnetic unit 2126 may be directed from the lower surface of the seventh magnetic unit 2126 to the upper surface (e.g., a direction indicated by an arrow f on a right side of the first magnetic unit 2102 in FIG. 29, the magnetization direction of the first magnetic unit 2102 may deflect 360 degrees in a clockwise direction). In some embodiments, the magnetization direction of the seventh magnetic unit 2126 may be opposite to that of the third magnetic unit 2110.

In some embodiments, at a position of the seventh magnetic unit 2126, the included angle between the direction of the magnetic field generated by magnetic circuit assembly 2700 and the direction of magnetization of the seventh magnetic unit 2126 may not be greater than 90 degrees. In some embodiments, at the position of the seventh magnetic unit 2126, the included angle between the direction of the magnetic field generated by the first magnetic unit 2102 and the magnetized direction of the seventh magnetic unit 2126 may be less than or equal to 90 degrees, such as 0 degrees, 10 degrees, or 20 degrees.

In the magnetic circuit assembly 2700, the third magnetically conductive unit 2116 may close the magnetic circuit generated by the magnetic circuit assembly 2700, so that more magnetic induction lines may concentrate in the magnetic gap, thereby implementing the effect of suppressing the magnetic leakage, increasing the magnetic induction intensity in the magnetic gap, and improving the sensitivity of a speaker device.

Figure 30:
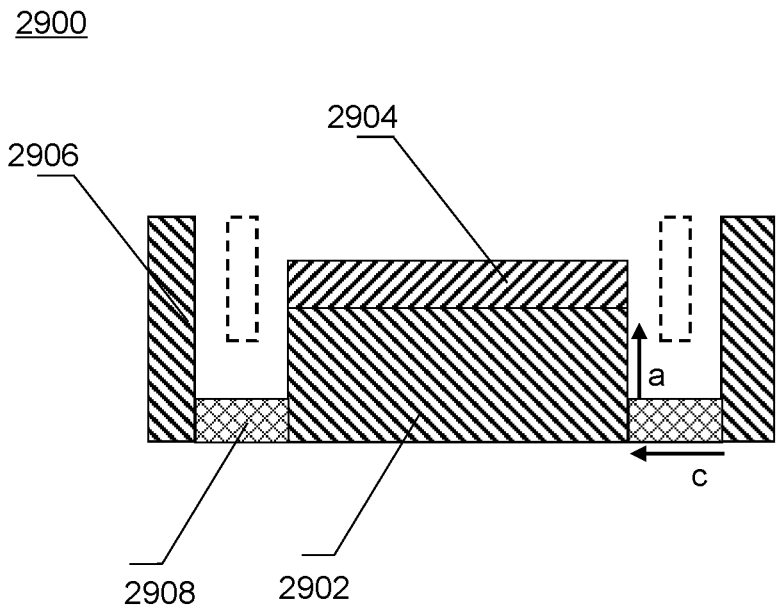
FIG. 30 is a schematic diagram illustrating a longitudinal sectional view of a magnetic circuit assembly 2900 according to some embodiments of the present disclosure.

FIG. 30 is a schematic diagram illustrating a longitudinal sectional view of a magnetic circuit assembly 2900 according to some embodiments of the present disclosure. As shown in FIG. 30, the magnetic circuit assembly 2900 may include a first magnetic unit 2902, a first magnetically conductive unit 2904, a first total magnetic field changing unit 2906, and a second magnetic unit 2908.

An upper surface of the first magnetic unit 2902 may be connected to a lower surface of the first magnetically conductive unit 2904. The second magnetic unit 2908 may be connected to the first magnetic unit 2902 and the first total magnetic field changing unit 2906. A connection manner between the first magnetic unit 2902, the first magnetically conductive unit 2904, the first total magnetic field changing unit 2906, and/or the second magnetic unit 2908 may include one or more connection manners described in the present disclosure. In some embodiments, the first magnetic unit 2902, the first magnetically conductive unit 2904, the first total magnetic field changing unit 2906, and/or the second magnetic unit 2908 may form a magnetic circuit and a magnetic gap.

In some embodiments, the magnetic circuit assembly 2900 may generate a first total magnetic field. The first magnetic unit 2902 may generate a second magnetic field. A magnetic field intensity of the first total magnetic field in the magnetic gap may be greater than a magnetic field intensity of the second magnetic field in the magnetic gap. In some embodiments, the second magnetic unit 2908 may generate a third magnetic field. The third magnetic field may increase the magnetic field intensity of the second magnetic field in the magnetic gap.

In some embodiments, an included angle between a magnetization direction of the first magnetic unit 2902 and a magnetization direction of the second magnetic unit 2908 may be between 0 degrees and 180 degrees. In some embodiments, the included angle between the magnetization direction of the first magnetic unit 2902 and the magnetization direction of the second magnetic unit 2908 may be between 45 degrees and 135 degrees. In some embodiments, the included angle between the magnetization direction of the first magnetic unit 2902 and the magnetization direction of the second magnetic unit 2908 may not be greater than 90 degrees.

In some embodiments, at a position of the second magnetic unit 2908, an included angle between a direction of the first total magnetic field and the magnetization direction of the second magnetic unit 2908 may not be higher than 90 degrees. In some embodiments, at the position of the second magnetic unit 2908, the included angle between the direction of the magnetic field generated by the first magnetic unit 2902 and the direction of magnetization of the second magnetic unit 2908 may be less than or equal to 90 degrees, such as 0 degrees, 10 degrees, or 20 degrees. As another example, the magnetization direction of the first magnetic unit 2902 may be perpendicular to the lower surface or the upper surface of the first magnetic unit 2902 and be vertically upward (e.g., a direction indicated by an arrow a in FIG. 30). The magnetization direction of the second magnetic unit 2908 may be directed from an outer ring of the second magnetic unit 2908 to an inner ring (e.g., a direction indicated by an arrow c in FIG. 30 on a right side of the first magnetic unit 2902, and the magnetization direction of the first magnetic unit 2902 may deflect 270 degrees in a clockwise direction).

Compared with a magnetic circuit assembly with a single magnetic unit, the first total magnetic field changing unit 2906 in the magnetic circuit assembly 2900 may increase a total magnetic flux in the magnetic gap, thereby increasing the magnetic induction intensity in the magnetic gap. In addition, under an action of the first total magnetic field changing unit 2906, originally scattered magnetic induction lines may converge at the position of the magnetic gap, thereby increasing the magnetic induction intensity in the magnetic gap.

Figure 31:
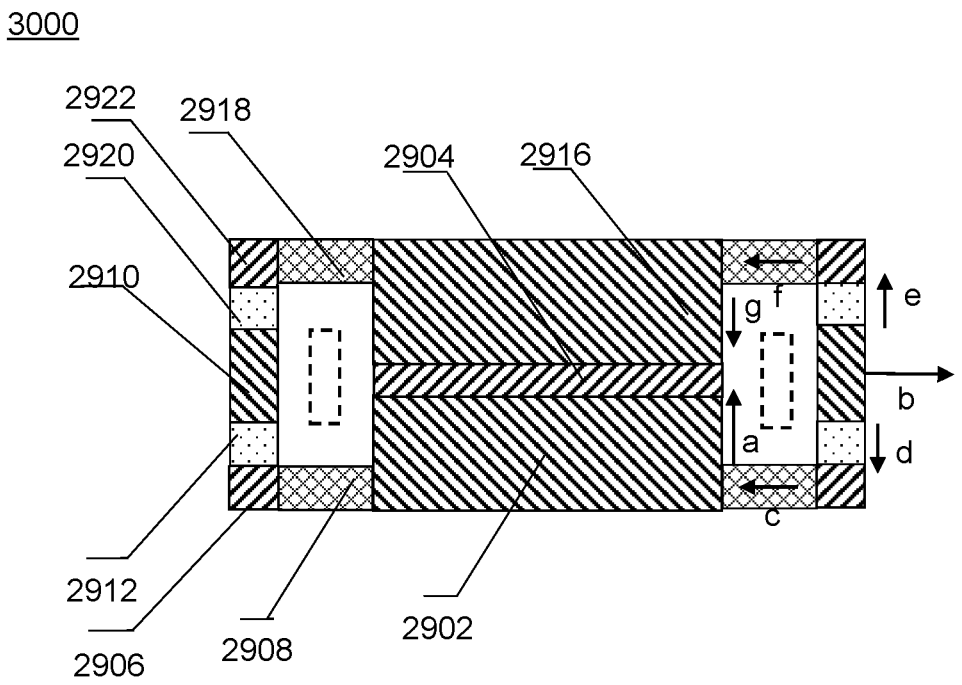
FIG. 31 is a schematic diagram illustrating a longitudinal sectional view of a magnetic circuit assembly 3000 according to some embodiments of the present disclosure.

FIG. 31 is a schematic diagram illustrating a longitudinal sectional view of a magnetic circuit assembly 3000 according to some embodiments of the present disclosure. As shown in FIG. 31, in some embodiments, the magnetic circuit assembly 3000 may include the first magnetic unit 2902, the first magnetically conductive unit 2904, the first total magnetic field changing unit 2906, the second magnetic unit 2908, a third magnetic unit 2910, a fourth magnetic unit 2912, a fifth magnetic unit 2916, a sixth magnetic unit 2918, a seventh magnetic unit 2920, and a second ring unit 2922. In some embodiments, the magnetic circuit assembly 3000 may include the first magnetic unit 2902, the first total magnetic field changing unit 2906, the second magnetic unit 2908, a third magnetic unit 2910, a fourth magnetic unit 2912, and a fifth magnetic unit 2916. In some embodiments, the first total magnetic field changing unit 2906 and/or the second ring unit 2922 may include an annular magnetic unit or an annular magnetically conductive unit. The annular magnetic unit may include one or more magnetic materials described in the present disclosure. The annular magnetically conductive unit may include one or more magnetically conductive materials described in the present disclosure.

In some embodiments, the sixth magnetic unit 2918 may be connected to the fifth magnetic unit 2916 and the second ring unit 2922. The seventh magnetic unit 2920 may be connected to the third magnetic unit 2910 and the second ring unit 2922. In some embodiments, the first magnetic unit 2902, the fifth magnetic unit 2916, the second magnetic unit 2908, the third magnetic unit 2910, the fourth magnetic unit 2912, the sixth magnetic unit 2918, and/or the seventh magnetic unit 2920, the first magnetically conductive unit 2904, the first total magnetic field changing unit 2906, and the second ring unit 2922 may form a magnetic circuit.

In some embodiments, an included angle between the magnetization direction of the first magnetic unit 2902 and a magnetization direction of the sixth magnetic unit 2918 may be between 0 degrees and 180 degrees. In some embodiments, the angle between the magnetization direction of the first magnetic unit 2902 and the magnetization direction of the sixth magnetic unit 2918 may be between 45 degrees and 135 degrees. In some embodiments, the included angle between the magnetization direction of the first magnetic unit 2902 and the magnetization direction of the sixth magnetic unit 2918 may not be higher than 90 degrees. In some embodiments, the magnetization direction of the first magnetic unit 2902 may be perpendicular to the lower surface or the upper surface of the first magnetic unit 2902 and be vertically upward (e.g., a direction indicated by an arrow a in FIG. 31). The magnetization direction of the sixth magnetic unit 2918 may be directed from an outer ring of the sixth magnetic unit 2918 to an inner ring (e.g., a direction indicated by an arrow f on a right side of the first magnetic unit 2902 in FIG. 31, the magnetization direction of the first magnetic unit 2902 may deflect 270 degrees in a clockwise direction). In some embodiments, in a same vertical direction, the magnetization direction of the sixth magnetic unit 2918 may be the same as that of the second magnetic unit 2908. In some embodiments, the magnetization direction of the first magnetic unit 2902 may be perpendicular to the lower surface or the upper surface of the first magnetic unit 2902 and be vertically upward (e.g., a direction indicated by the arrow a in FIG. 31). The magnetization direction of the seventh magnetic unit 2920 may be directed from the lower surface of the seventh magnetic unit 2920 to the upper surface (e.g., a direction indicated by an arrow e on the right side of the first magnetic unit 2902 in FIG. 31, the magnetization direction of the first magnetic unit 2902 may deflect 360 degrees in the clockwise direction). In some embodiments, a magnetization direction of the seventh magnetic unit 2920 may be the same as that of the fourth magnetic unit 2912.

In some embodiments, at a position of the sixth magnetic unit 2918, an included angle between a direction of a magnetic field generated by the magnetic circuit assembly 2900 and the magnetization direction of the sixth magnetic unit 2918 may be not greater than 90 degrees. In some embodiments, at the position of the sixth magnetic unit 2918, the included angle between the direction of the magnetic field generated by the first magnetic unit 2902 and the direction of magnetization of the sixth magnetic unit 2918 may be less than or equal to 90 degrees, such as 0 degrees, 10 degrees, or 20 degrees.

In some embodiments, an included angle between the magnetization direction of the first magnetic unit 2902 and the magnetization direction of the seventh magnetic unit 2920 may be between 0 degrees and 180 degrees. In some embodiments, the included angle between the magnetization direction of the first magnetic unit 2902 and the magnetization direction of the seventh magnetic unit 2920 may be between 45 degrees and 135 degrees. In some embodiments, the included angle between the magnetization direction of the first magnetic unit 2902 and the magnetization direction of the seventh magnetic unit 2920 may not be greater than 90 degrees.

In some embodiments, at a position of the seventh magnetic unit 2920, an included angle between a direction of a magnetic field generated by the magnetic circuit assembly 3000 and the magnetization direction of the seventh magnetic unit 2920 may be not higher than 90 degrees. In some embodiments, at the position of the seventh magnetic unit 2920, an included angle between the direction of the magnetic field generated by the first magnetic unit 2902 and the direction of magnetization of the seventh magnetic unit 2920 may be less than or equal to 90 degrees, such as 0 degrees, 10 degrees, or 20 degrees.

In some embodiments, the first total magnetic field changing unit 2906 may include an annular magnetic unit. In this case, a magnetization direction of the first total magnetic field changing unit 2906 may be the same as the magnetization direction of the second magnetic unit 2908 or the magnetization direction of the fourth magnetic unit 2912. For example, on a right side of the first magnetic unit 2902, the magnetization direction of the first total magnetic field changing unit 2906 may be directed from an outer ring to an inner ring of the first total magnetic field changing unit 2906. In some embodiments, the second ring unit 2922 may include an annular magnetic unit. In this case, a magnetization direction of the second ring unit 2922 may be the same as that of the sixth magnetic unit 2918 or that of the seventh magnetic unit 2920. For example, on the right side of the first magnetic unit 2902, the magnetization direction of the second ring unit 2922 may be directed from an outer ring to an inner ring of the second ring unit 2922.

In the magnetic circuit assembly 3000, a plurality of magnetic units may increase the total magnetic flux. Different magnetic units may interact with each other, thereby suppressing the leakage of the magnetic induction lines, increasing the magnetic induction intensity in the magnetic gap, and improving the sensitivity of a speaker device.

Figure 32:
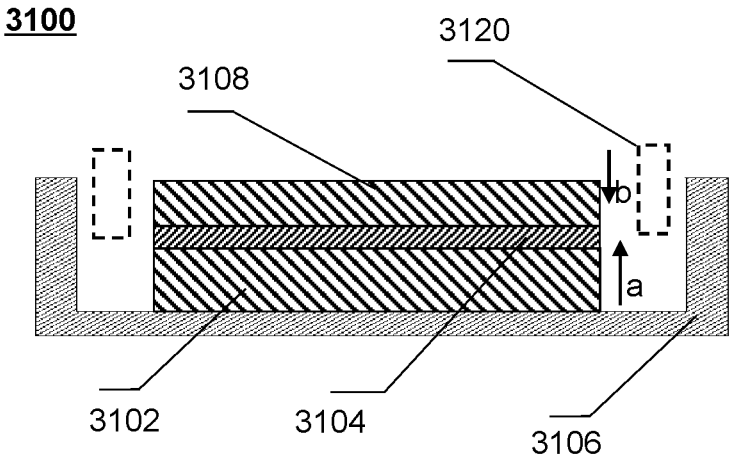
FIG. 32 is a schematic diagram illustrating a longitudinal sectional view of a magnetic circuit assembly 3100 according to some embodiments of the present disclosure.

FIG. 32 is a structure diagram illustrating a longitudinal sectional view of a magnetic circuit assembly 3100 according to some embodiments of the present disclosure. As shown in FIG. 32, the magnetic circuit assembly 3100 may include a first magnetic unit 3102, a first magnetically conductive unit 3104, a second magnetically conductive unit 3106, and a second magnetic unit 3108.

In some embodiments, the first magnetic unit 3102 and/or the second magnetic unit 3108 may include one or more magnets described in the present disclosure. In some embodiments, the first magnetic unit 3102 may include a first magnet. The second magnetic unit 3108 may include a second magnet. The first magnet may be the same as or different from the second magnet. The first magnetically conductive unit 3104 and/or the second magnetically conductive unit 3106 may include one or more magnetically conductive materials described in the present disclosure. A processing manner of the first magnetically conductive unit 3104 and/or the second magnetically conductive unit 3106 may include one or more processing manners described in the present disclosure. In some embodiments, the first magnetic unit 3102, the first magnetically conductive unit 3104, and/or the second magnetic unit 3108 may be disposed as an axisymmetric structure. For example, the first magnetic unit 3102, the first magnetically conductive unit 3104, and/or the second magnetic unit 3108 may be cylinders. In some embodiments, the first magnetic unit 3102, the first magnetically conductive unit 3104, and/or the second magnetic unit 3108 may be coaxial cylinders with the same diameter or different diameters. A thickness of the first magnetic unit 3102 may be greater than or equal to a thickness of the second magnetic unit 3108. In some embodiments, the second magnetically conductive unit 3106 may have a groove-type structure. The groove-type structure may include a U-shaped section. The second magnetically conductive unit 3106 with the groove-type structure may include a bottom plate and at least one sidewall. In some embodiments, the bottom plate and the at least one sidewall may be integrally formed as a whole. For example, the at least one sidewall may be formed by extending the bottom plate in a direction perpendicular to the bottom plate. In some embodiments, the bottom plate may be connected to the at least one sidewall through one or more connection manners described in the present disclosure. The second magnetic unit 3108 may be disposed as an annular shape or a sheet shape. More descriptions regarding the shape of the second magnetic unit 3108 may be found elsewhere in the present disclosure. In some embodiments, the second magnetic unit 3108 may be coaxial with the first magnetic unit 3102 and/or the first magnetically conductive unit 3104.

An upper surface of the first magnetic unit 3102 may be connected to a lower surface of the first magnetically conductive unit 3104. A lower surface of the first magnetic unit 3102 may be connected to the bottom plate of the second magnetically conductive unit 3106. A lower surface of the second magnetic unit 3108 may be connected to an upper surface of the first magnetically conductive unit 3104. A connection manner between the first magnetic unit 3102, the first magnetically conductive unit 3104, the second magnetically conductive unit 3106, and/or the second magnetic unit 3108 may include one or more connection manners, such as an adhesive connection, a snap-fit manner, a welding manner, a riveting manner, a bolting manner, or the like, or any combination thereof.

A magnetic gap may be formed between the first magnetic unit 3102, the first magnetically conductive unit 3104, and/or the second magnetic unit 3108 and the sidewall of the second magnetically conductive unit 3106. A voice coil may be disposed in the magnetic gap. In some embodiments, the first magnetic unit 3102, the first magnetically conductive unit 3104, the second magnetically conductive unit 3106, and the second magnetic unit 3108 may form a magnetic circuit. In some embodiments, the magnetic circuit assembly 3100 may generate a first total magnetic field. The first magnetic unit 3102 may generate a second magnetic field. The first total magnetic field may be formed by magnetic fields generated by components (e.g., the first magnetic unit 3102, the first magnetically conductive unit 3104, the second magnetically conductive unit 3106, and the second magnetic unit 3108) of the magnetic circuit assembly 3100. A magnetic field intensity (also referred to as magnetic induction intensity or magnetic flux density) of the first total magnetic field in the magnetic gap may be greater than a magnetic field intensity of the second magnetic field in the magnetic gap. In some embodiments, the second magnetic unit 3108 may generate a third magnetic field. The third magnetic field may increase the magnetic field intensity of the second magnetic field in the magnetic gap.

In some embodiments, an included angle between a magnetization direction of the second magnetic unit 3108 and a magnetization direction of the first magnetic unit 3102 may be between 90 degrees and 180 degrees. In some embodiments, the included angle between the magnetization direction of the second magnetic unit 3108 and the magnetization direction of the first magnetic unit 3102 may be between 150 degrees and 180 degrees. In some embodiments, the magnetization direction (e.g., a direction indicated by an arrow a in FIG. 32) of the second magnetic unit 3108 may be opposite to the magnetization direction (e.g., a direction indicated by an arrow b in FIG. 32) of the first magnetic unit 3102.

Compared with a magnetic circuit assembly with a single magnetic unit, the magnetic circuit assembly 3100 may include the second magnetic unit 3108. The magnetization direction of the second magnetic unit 3108 may be opposite to the magnetization direction of the first magnetic unit 3102, which may suppress a magnetic leakage of the first magnetic unit 3102 in the magnetization direction. Relatively more magnetic field generated by the first magnetic unit 3102 may be compressed into the magnetic gap, thereby increasing the magnetic induction intensity within the magnetic gap.

It should be noted that the description of the speaker device described above is merely for illustration purposes and should not be regarded as the only feasible implementation solution. Obviously, for those skilled in the art, after understanding the basic principle of the speaker device, it may be possible to make various modifications and changes in forms and details of the specific methods and operations of implementing the speaker device without departing from the principles. However, these modifications and changes are still within the scope of the present disclosure. For example, magnetic unit(s) in a magnetic circuit assembly is not limited to a first magnetic unit, a second magnetic unit, a third magnetic unit, a fourth magnetic unit, a fifth magnetic unit, a sixth magnetic unit, a seventh magnetic unit as described above. The number (or a count) of the magnetic unit(s) may be decreased or increased according to an actual condition. Such modifications, changes, and/or variations are all within the protection scope of the present disclosure.

In some embodiments, the speaker device (e.g., the MP3 player) described above may transmit the sound to the user through air conduction. When the air conduction is used to transmit the sound, the speaker device may include one or more sound sources. The sound source may be located at a specific position of the user's head, for example, the top of the head, a forehead, a cheek, a temple, an auricle, the back of an auricle, etc., without blocking or covering an ear canal. For purposes of illustration, FIG. 33 is a schematic diagram illustrating transmitting sound through air conduction according to some embodiments of the present disclosure.

Figure 33:
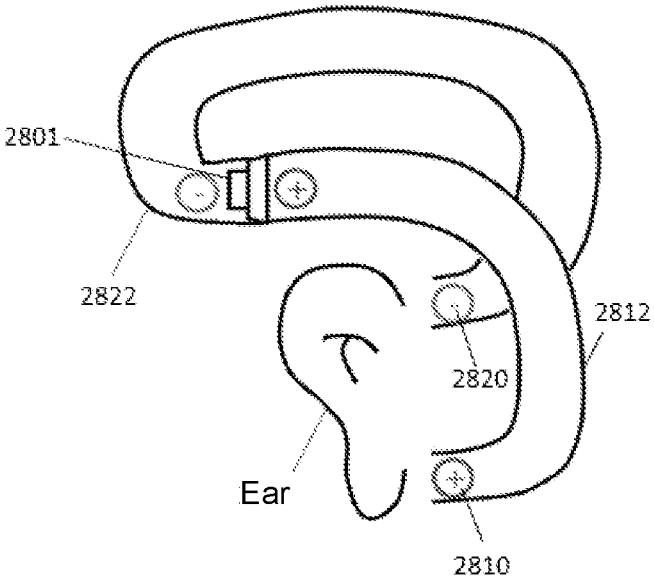
FIG. 33 is a schematic diagram illustrating sound transmission through air conduction according to some embodiments of the present disclosure.

As shown in FIG. 33, a sound source 3310 and a sound source 3320 may generate sound waves with opposite phases ("+" and "−" in FIG. 33 may indicate the opposite phases). For brevity, the sound sources used herein refers to sound outlets of a speaker device that output sounds. For example, the sound source 3310 and the sound source 3320 may be two sound outlets respectively located at a specific position (e.g., the core housing 20 or the circuit housing 30) of the speaker device.

In some embodiments, the sound source 3310 and the sound source 3320 may be generated by a same vibration device 3301. The vibration device 3301 may include a diaphragm (not shown in FIG. 33). When the diaphragm is driven to vibrate by an electric signal, a front side of the diaphragm may drive air to vibrate. The sound source 3310 may be formed at a sound output hole through a sound guiding channel 3312. A back side of the diaphragm may drive air to vibrate, and the sound source 3320 may be formed at a sound output hole through a sound guiding channel 3322. The sound guiding channel refers to a sound transmission route from the diaphragm to the corresponding outlet. In some embodiments, the sound guiding channel may be a route surrounded by a specific structure (e.g., the core housing 20 or the circuit housing 30) on the speaker device. It should be noted that, in some alternative embodiments, the sound source 3310 and the sound source 3320 may be generated by different vibrating diaphragms of different vibration devices, respectively.

Among the sounds generated by the sound source 3310 and the sound source 3320, one portion of the sounds may be transmitted to the ear of a user to form a sound heard by the user. Another portion of the sound may be transmitted to the environment to form a leaked sound. Considering that the sound source 3310 and the sound source 3320 are relatively close to the ears of the user, for convenience of description, the sound transmitted to the ear of the user may be referred to as a near-field sound. The leaked sound transmitted to the environment may be referred to as a far-field sound. In some embodiments, the near-field/far-field sounds with different frequencies generated by the speaker device may be related to a distance between the sound source 3310 and the sound source 3320. Generally, the near-field sound generated by the speaker device may increase along with an increment of the distance between the two sound sources, and the far field sound (i.e., the leaked sound) may increase along with an increment of a frequency.

For sounds with different frequencies, the distance between the sound source 3310 and the sound source 3320 may be designed, respectively, so that a low-frequency near-field sound (e.g., a sound with a frequency less than 800 Hz) generated by the speaker device may be relatively great, and a far-field sound with the relatively high frequency (e.g., a sound with a frequency greater than 2000 Hz) may be relatively small. In order to implement the above purpose, the speaker device may include two or more sets of dual sound sources. Each set of the dual sound sources may include two sound sources similar to the sound source 3310 and the sound source 3320, and generate sounds with a specific frequency, respectively. Specifically, a first set of the dual sound sources may be used to generate a sound with a relatively low frequency. A second set of the dual sound sources may be used to generate a sound with a relatively great frequency. To increase a volume of the near-field sound with the relatively low frequency, the distance between two sound sources in the first set of the dual sound sources may be set with a relatively large value. Since the low-frequency near-field sound may have a relatively long wavelength, the relatively great distance between the two sound sources may not cause a relatively great phase difference in the far-field, and thereby reducing sound leakage in the far-field. To reduce the far-field sound with the relatively high frequency, the distance between the two sound sources in the second set of the dual sound sources may be set with a relatively small value. Since the far-field sound with the relatively high frequency may have a relatively short wavelength, the relatively small distance between the two sound sources may avoid the generation of a relatively large phase difference in the far-field, thereby reducing the sound leakage. The distance between the two sound sources of the second set of the dual sound sources may be less than the distance between the two sound sources of the first set of the dual sound sources.

The beneficial effects of the embodiments of the present disclosure may include but are not limited to the following benefits. (1) Waterproof performance of the speaker device may be improved through sealed connections between various components of the speaker device in this present disclosure. (2) The angle θ formed between the normal line A and the line B or between the normal line A' and the line B can be adjusted, thereby improving the sound quality of the speaker device. (3) By improving an overall rigidity of the housing of the speaker device, the housing front panel, and the housing rear panel may keep the same or substantially the same vibration amplitude and phase at a relatively high frequency, thereby reducing the sound leakage of the speaker device. (4) The sensitivity of the speaker device can be improved by increasing magnetic components, magnetic elements, and conductive elements in the magnetic circuit assembly. It should be noted that different embodiments may have different beneficial effects. In different embodiments, the possible beneficial effects may be any one or a combination of the beneficial effects described above, or any other beneficial effects.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment," "one embodiment," or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "block," "module," "device," "unit," "component," or "system." Furthermore, aspects of the present disclosure may take the form of a computer program product embodied in one or more computer-readable media having computer-readable program code embodied thereon.

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, the numbers expressing quantities of ingredients, properties, and so forth, used to describe and claim certain embodiments of the application are to be understood as being modified in some instances by the term "about," "approximate," or "substantially" and etc. Unless otherwise stated, "about," "approximate," or "substantially" may indicate ±20% variation of the value it describes. Accordingly, in some embodiments, the numerical parameters set forth in the description and attached claims are approximations that may vary depending upon the desired properties sought to be obtained by a particular embodiment. In some embodiments, numerical data should take into account the specified significant digits and use an algorithm reserved for general digits. Notwithstanding that the numerical ranges and parameters configured to illustrate the broad scope of some embodiments of the present disclosure are approximations, the numerical values in specific examples may be as accurate as possible within a practical scope.

At last, it should be understood that the embodiments described in the present application are merely illustrative of the principles of the embodiments of the present application. Other modifications that may be employed may be within the scope of the application. Thus, by way of example, but not of limitation, alternative configurations of the embodiments of the application may be utilized in accordance with the teachings herein. Accordingly, embodiments of the present disclosure are not limited to that precisely as shown and described.

We claim:

1. A speaker device, comprising:

a circuit housing configured to accommodate a control circuit or a battery, the control circuit or the battery being configured to drive an earphone core to vibrate to generate a sound;

a core housing configured to accommodate the earphone core; the core housing including a housing front panel facing a human body and a housing rear panel opposite to the housing front panel; the earphone core being configured to cause the housing front panel and the housing rear panel to vibrate, vibration of the housing front panel having a first phase, and vibration of the housing rear panel having a second phase; wherein an absolute value of a difference between the first phase and the second phase is less than 60 degrees when a frequency of each of the vibration of the housing front panel and the vibration of the housing rear panel is within a range between 2000 Hz and 3000 Hz;

an ear hook configured to connect the core housing and the circuit housing; and a housing sheath at least partially covering the circuit housing and the ear hook, the housing sheath being made of a waterproof material.

2. The speaker device of claim 1, wherein
the housing sheath includes a bag-like structure with an open end; and
the circuit housing enters the housing sheath through the open end of the housing sheath.

3. The speaker device of claim 2, wherein
the open end of the housing sheath includes an annular flange that protrudes inward, and
the annular flange abuts against an end of the circuit housing away from the ear hook when the housing sheath covers a periphery of the circuit housing.

4. The speaker device of claim 3, wherein
a sealant is applied to a joint area between the annular flange and the end of the circuit housing away from the ear hook to connect the housing sheath and the circuit housing in a sealed manner.

5. The speaker device of claim 3, wherein
the end of the circuit housing away from the ear hook includes a first annular table, and
the first annular table is configured to connect with the annular flange in a clamping manner for positioning the housing sheath, wherein
the first annular table includes a positioning block that extends along a direction in which the circuit housing is away from the ear hook, and
the annular flange of the housing sheath includes a positioning groove corresponding to the positioning block, the positioning groove being configured to accommodate at least a portion of the positioning block for positioning the housing sheath.

6. The speaker device of claim 3, wherein
the circuit housing includes two sub-housings connected to each other in a snap-fit connection,
the housing sheath covers a joint seam of the two sub-housings, and
joint surfaces of the two sub-housings abutted on each other include stepped structures that are mutually matched.

7. The speaker device of claim 1, wherein
the core housing includes a first socket;
the ear hook includes an elastic metal wire and a first plug end,
the first plug end is disposed on an end of the elastic metal wire, and
the first plug end is connected to the first socket in a plugged-in connection.

8. The speaker device of claim 7, wherein
a stopping block is disposed on an inner side wall of the first socket; and
the first socket includes:
an insertion unit, at least a portion of the insertion unit being inserted into the first socket and abutted against an outer surface of the stopping block; and
two elastic hooks disposed on a side of the insertion unit facing an inside of the core housing, the two elastic hooks are drawn close to each other under the action of an external force and the stopping block, and after passing the stopping block, the two elastic hooks elastically returning to be clamped on the inner surface of the stopping block to form a plugged-in connection between the core housing and the first plug end.

9. The speaker device of claim 8, wherein
at least a portion of the insertion unit is inserted into the first socket, the other portion of the insertion unit outside of the first socket has a stepped structure and form a second annular table, and the second annular table is disposed apart from an outer end surface of the core housing; and
the ear hook further includes a protective sleeve disposed on a periphery of the elastic metal wire and the first plug end, the protective sleeve extends to a side of the second annular table facing the outer end surface of the core housing, and the protective sleeve elastically abuts against the core housing when the core housing and the first plug end are in a plugged-in connection.

10. The speaker device of claim 9, wherein
the protective sleeve includes an annular abutting surface and an annular convex table, the annular abutting surface being formed on a side of the protective sleeve facing the outer end surface of the core housing, and the annular convex table being formed inside the annular abutting surface and protruding toward the annular abutting surface;
the core housing includes a connecting slope configured to connect the outer end surface of the core housing and the inner side wall of the first socket; and
the annular abutting surface and the annular convex table elastically abut against the outer end surface of the core housing and the connecting slope, respectively, when the first plug end is fixedly plugged in the core housing.

11. The speaker device of claim 1, wherein
the vibration of the housing front panel has a first amplitude,
the vibration of the housing rear panel has a second amplitude, and
a ratio of the first amplitude to the second amplitude is within a range from 0.5 to 1.5.

12. The speaker device of claim 1, wherein
the vibration of the housing front panel generates a first leaked sound wave,
the vibration of the housing back generates a second leaked sound wave, and
the first leaked sound wave and the second leaked sound wave overlap to reduce an amplitude of the first leaked sound wave.

13. The speaker device of claim 1, wherein
the vibration caused by the earphone core generates a driving force;
the housing front panel is connected to the earphone core via a transmission connection;
at least a portion of the housing front panel is connected to or abuts against the human body of a user to transmit sound; and
an area of the housing front panel contacted with or abutting against the human body includes a normal line, a line where the driving force locates being unparallel to the normal line.

14. The speaker device of claim 13, wherein
a positive direction of the line where the driving force locates is set outwards the speaker device from the housing front panel,
a positive direction of the normal line is set outwards the speaker device, and
an angle formed between the line where the driving force locates along the positive direction of the line and the normal line along the positive direction of the normal line is an acute angle.

15. The speaker device of claim 13, wherein
the earphone core includes a coil and a magnetic circuit system,
an axis of the coil or an axis of the magnetic circuit system is unparallel to the normal line, and the axis of the coil or the axis of the magnetic circuit system is perpendicular to a radial plane of the coil or a radial plane of the magnetic circuit assembly.

16. The speaker device of claim 13, wherein the driving force has a component in a first quadrant and/or a third quadrant of an XOY plane coordinate system, an origin of the XOY plane coordinate system is located on a contact surface between the speaker device and the human body, an X-axis of the XOY plane coordinate system is parallel to a coronal axis of the human body, a Y-axis is parallel to a sagittal axis of the human body, a positive direction of the X-axis faces outside of the human body, and a positive direction of the Y-axis faces the front of the human body.

17. The speaker device of claim 13, wherein the area of the housing front panel connected with or abutting against the human body includes a plane or a quasi-plane.

18. The speaker device of claim 1, wherein the earphone core further includes a magnetic circuit assembly, the magnetic circuit assembly generating a first magnetic field, the magnetic circuit assembly includes a first magnetic unit, the first magnetic unit generating a second magnetic field;

a first magnetically conductive unit;

at least one second magnetic unit, the at least one second magnetic unit surrounding the first magnetic unit, a magnetic gap being formed between the first magnetic unit and the at least one second magnetic unit, and an intensity of the first magnetic field in the magnetic gap being greater than an intensity of the second magnetic field in the magnetic gap.

19. The speaker device of claim 18, further comprising a second magnetically conductive unit and at least one third magnetic unit, at least one fourth magnetic unit, at least one fifth magnetic unit, and a third magnetically conductive unit, wherein the at least one third magnetic unit is connected to the second magnetically conductive unit and the at least one second magnetic unit;

the at least one fourth magnetic unit is disposed below the magnetic gap and connected to the first magnetic unit and the second magnetically conductive unit;

the at least one fifth magnetic unit is connected to an upper surface of the first magnetically conductive unit; and the third magnetically conductive unit is connected to an upper surface of the fifth magnetic unit and configured to suppress the leakage of a magnetic intensity of the first magnetic field.

20. The speaker device of claim 19, wherein the first magnetically conductive unit is connected to an upper surface of the first magnetic unit, the second magnetically conductive unit includes a bottom plate and a sidewall, and the first magnetic unit is connected to the bottom plate of the second magnetically conductive unit.

* * * * *